US007491084B2

(12) United States Patent
Wedler et al.

(10) Patent No.: US 7,491,084 B2
(45) Date of Patent: Feb. 17, 2009

(54) CONNECTOR SYSTEM FOR TAPPING OFF BRANCH LINES FROM CONTINUOUS CONDUCTORS

(75) Inventors: Andreas Wedler, Detmold (DE); Günter Lucht, Horn-Bad Meinberg (DE); Joachim Bury, Herford (DE); John Witt, Detmold (DE); Paulo Russo, Lage (DE); Peter Stuckmann, Lage (DE); Thomas Pieper, Geseke (DE); Thomas Salomon, Gütersloh (DE); Thorsten Diekmann, Leopoldshöhe (DE); Uwe Arlitt, Leopoldshöhe (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/974,830

(22) Filed: Oct. 16, 2007

(65) Prior Publication Data

US 2008/0096416 A1 Apr. 24, 2008

(30) Foreign Application Priority Data

Oct. 18, 2006 (DE) ..... 20 2006 015 946 U

(51) Int. Cl.
*H01R 4/24* (2006.01)

(52) U.S. Cl. ..... 439/404; 439/709; 439/716

(58) Field of Classification Search ..... 439/404, 439/406, 409, 410, 212, 709, 716, 717
See application file for complete search history.

(56) References Cited

U.S. PATENT DOCUMENTS

| | | | | |
|---|---|---|---|---|
| 5,635,001 | A | 6/1997 | Meyerhoefer | |
| 7,234,961 | B2 | 6/2007 | Arlitt | |
| 7,407,406 | B2 * | 8/2008 | Arlitt et al. | 439/404 |

FOREIGN PATENT DOCUMENTS

| | | | |
|---|---|---|---|
| DE | 297 06 750 | U1 | 7/1997 |
| DE | 299 05 025 | U1 | 7/1999 |
| DE | 199 03 030 | C1 | 5/2001 |
| WO | WO 01/22534 | A1 | 3/2001 |

* cited by examiner

*Primary Examiner*—Briggitte R Hammond
*Assistant Examiner*—Vanessa Girardi
(74) *Attorney, Agent, or Firm*—Lawrence E Laubscher, Sr.; Lawrence E Laubscher, Jr.

(57) ABSTRACT

A connector system includes a plurality of conductor piercing units supported by a frame for vertical displacement between upper disconnected and lower connected positions relative to a plurality of parallel spaced insulated conductors supported in a horizontal plane by a base plate. The piercing units are displaced between said upper and lower positions by operating disks eccentrically mounted for rotation on a horizontal support shaft that extends between an opposed pair of side walls of the frame. The base plate, frame and piercing unit assembly are arranged in an open-topped support housing that is closed by a cover member or lid. Electrical components may by mounted on the lid for connection with the piercing unit assembly.

8 Claims, 27 Drawing Sheets

CONNECTOR SYSTEM FOR TAPPING OFF BRANCH LINES FROM CONTINUOUS CONDUCTORS

REFERENCE TO RELATED APPLICATIONS

This application is related to the copending companion Arlitt et al application Ser. No. 11/519,250 filed Sep. 12, 2006

BACKGROUND OF THE INVENTION

1. Field of the Invention

A connector system includes a plurality of conductor piercing units supported by a frame for vertical displacement between upper disconnected and lower connected positions relative to a plurality of parallel spaced insulated conductors supported in a horizontal plane by a base plate. The piercing units are displaced between said upper and lower positions by operating disks eccentrically mounted for rotation on a horizontal support shaft that extends between an opposed pair of side walls of the frame. The base plate, frame and piercing unit assembly are arranged in an open-topped support housing that is closed by a cover member or lid. Electrical components are mounted on the lid for connection with the piercing unit assembly.

2. Description of Related Art

Conductor connection devices are well known in the patented prior art, as evidenced by the U.S. patent to Arlitt et al U.S. Pat. No. 7,234,961, and the German patent No. DE 297 08 222 U1, among others. These connection devices are used to make branches on a plurality of continuous conductors, without having to cut the continuous conductors. For this purpose, plurality of groove-like seats is made on a base plate in which seats one can insert a flat cable or a plurality of electrical conductors, parallel to each other. Then an upper part is put on in order to fix the conductors or the flat cable. Upon this preassembled unit, that is provided with partitions, one then locks clamp-like bodies in one swing motion which in each case are provided with an insulation-penetrating contact that is connected via a bus bar with two tension spring clamps for the connection of branching conductors. In this way, one can make, in each case, two branches upon each conductor without having to separate the continuing conductors.

It is also known that one can arrange connecting discs on a shaft, rotatably upon a bottom plate. But that design did not work satisfactorily because the conductors must be inserted laterally, so that this arrangement is not suitable for assembly on previously installed continuous cables.

The present invention therefore starts with the typical state of the art and intends to optimize the latter in terms of construction design. The invention creates a connection system by means of which one can in a simple manner make connection devices performing various functions, building upon a kind of base unit by exchanging the lid closure members.

This measure makes it possible, among other things, to provide a simple and secure mounting of the flat cable conductors with a compact structure. This structure has a cover housing or a base housing and is then combined with a functional lid, depending upon the task to be performed, whereby the supplied lids of the system are designed either merely for coverage or are provided with additional functional elements, in particular, electrical structural elements, plug connections or manual switches, luminous diodes, miscellaneous other displays or the like.

The functional elements in this case are preferably arranged directly above the actual base connection device, something which reduces the surface requirement of the connection devices of the connection system.

In design terms, the arrangement of the connection device as such is definitely further simplified, when compared to the state of the art, because, for wiring purposes, it preferably employs IDC contacts that can be worked without any screws, in particular, fork contacts. The module frame is well suited for absorbing the forces especially during the wiring phase. In the process, the connection module as such creates a unit that can already be pre-assembled by the manufacturer, which unit absorbs the essential wiring forces without excessively overloading the bottom plate. In this way it is moreover possible in a simple manner to contact both the continuous conductors and the branch conductors (at any rate, when one employs direct plug contacts), in a simple fashion. There is no need for putting on individual disks, although each of the conductors remains individually arranged for connection.

The continuing conductors for instance can be the continuous conductors of a flat cable or some other cable—for instance, a round cable—whose cable sheath was removed in the area of the connection system, whereby the continuous conductors—in this area where the sheath has been stripped away—are inserted into the seats in the bottom plate.

For the purpose of contacting, only the pre-assembled connection module need to be put on whereupon the connection disks must be pushed into the contact position and the conductor ends are inserted into the branch conductors. In that way, one can quickly and subsequently assemble a branch also upon an already installed cable.

Preferably, the connection disks and thus especially also the insulation-penetrating contacts arranged thereupon, are so made that they can be simply pushed in the actuation shafts, in order to ensure a clearly defined contacting perpendicularly to the extent of the conductors. In that way one can advantageously avoid a swing motion of the insulation penetrating contacts during contacting.

Preferably, actuation devices are associated with the connection disks for the purpose of moving, especially shifting of the connection disks in the actuation shafts. In that way, the connection disks are moved as a whole in a defined manner in the module shafts, something that assures large-surface sliding bearing and defined guidance of the IDC contacts during the contacting of the conductors.

Here it is particularly advantageous when the actuation devices are made as eccentric devices with eccentric disks, because the latter facilitate a high degree of force transmission in a narrow space.

SUMMARY OF THE INVENTION

Accordingly, a primary object of the invention is to provide a connector system including a plurality of conductor piercing units supported by a frame for selective vertical displacement between upper disconnected and lower connected positions relative to a plurality of parallel spaced insulated conductors supported in a horizontal plane by a base plate, wherein the piercing unit assembly is mounted in an open-topped support housing that is closed by a lid or cover member that carries electrical components that are connected with the piercing unit assembly.

According to a more specific object of the invention, the piercing units are displaced between said upper and lower positions by operating disks eccentrically mounted for rotation on a horizontal support shaft that extends between an opposed pair of side walls of the frame, which frame is fastened to a base plate that is mounted in the support housing.

According to a more specific object of the invention, the base plate, frame and piercing unit assembly is arranged in an open-topped support housing having end walls containing openings through which the supply cables extend. Seal means may be provided for sealing the space between the cables and the wall openings. The housing is adapted for use with various lids or cover members that carry different electrical components adapted for connection with the output conductors leading from piercing unit assembly, and some of which contain inspection openings that afford access to the interior of the housing.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
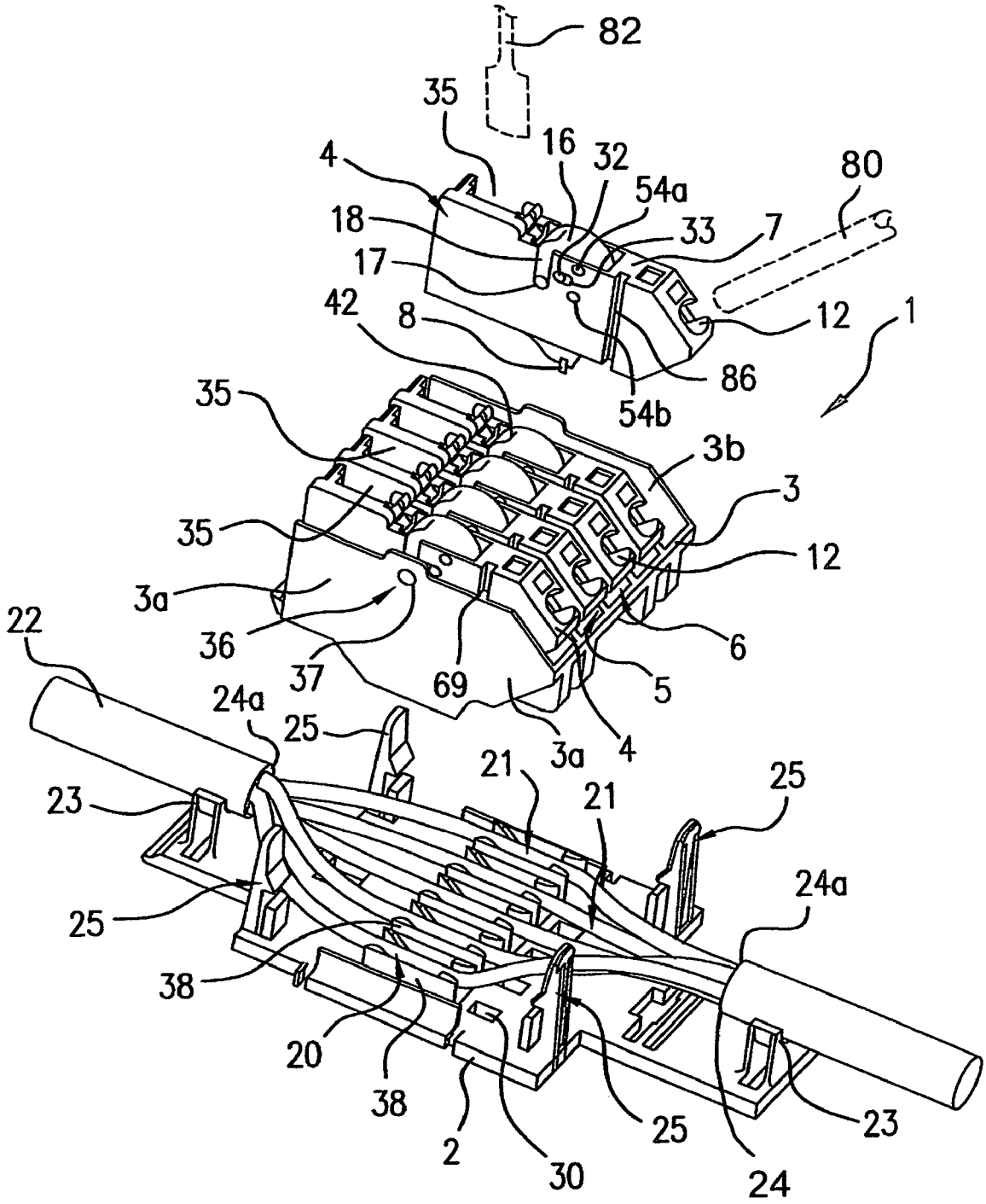
FIG. 1 is an exploded perspective view of a first embodiment of the connector apparatus of the present invention.

Referring first more particularly to FIG. 1, the connector system 1 of the present invention includes a rigid horizontal base plate 2 adapted to receive a rectangular frame 3 having a pair of parallel spaced vertical side walls 3*a* and 3*b* between which are arranged fixed parallel spaced partition walls 5 that define chambers 6 for receiving a plurality of generally rectangular conductor piercing units 4. Vertical tongue and groove means 86 are provided between the partitions 5 and the side walls 19 for guiding the piercing units during their vertical displacement relative to the frame.

The base plate 2 includes a plurality of parallel coplanar conductor seats 20 that receive the separated fanned-out insulated conductors 21 of a cable 22 having an outer sheath layer 24 a section of which has been removed, thereby to define the longitudinally spaced sheath ends 24*a*. Fastener elements 38 retain the conductors 21 in their respective seats, and cable support members 23 at opposite ends of the base plate support the cable portions on opposition side of the stripped cable section. The base also includes four vertical snap fastener devices 25 that cooperate with corresponding edges on the frame to retain the frame and piercing unit assembly on the base plate.

Figure 2A:
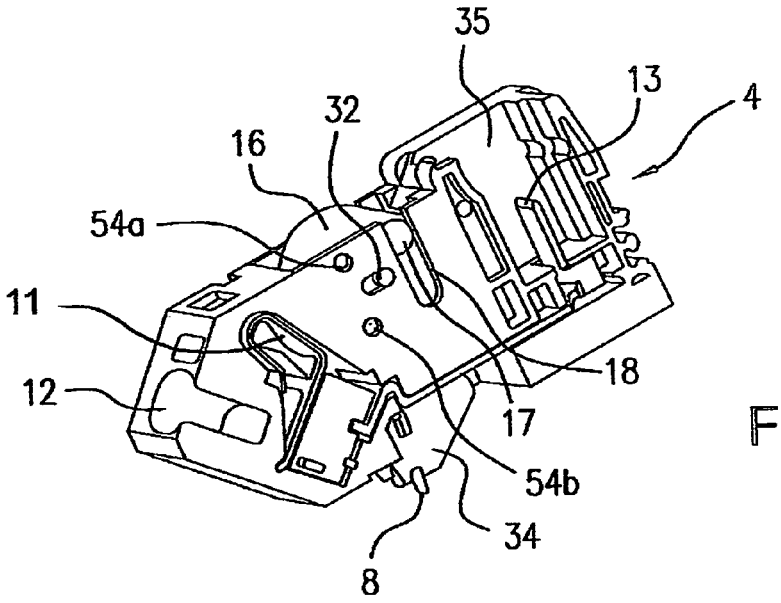
FIGS. 2*a* and 2*b* are perspective side and exploded views, respectively, of one of the connector piercing units of FIG. 1.
Figure 2B:
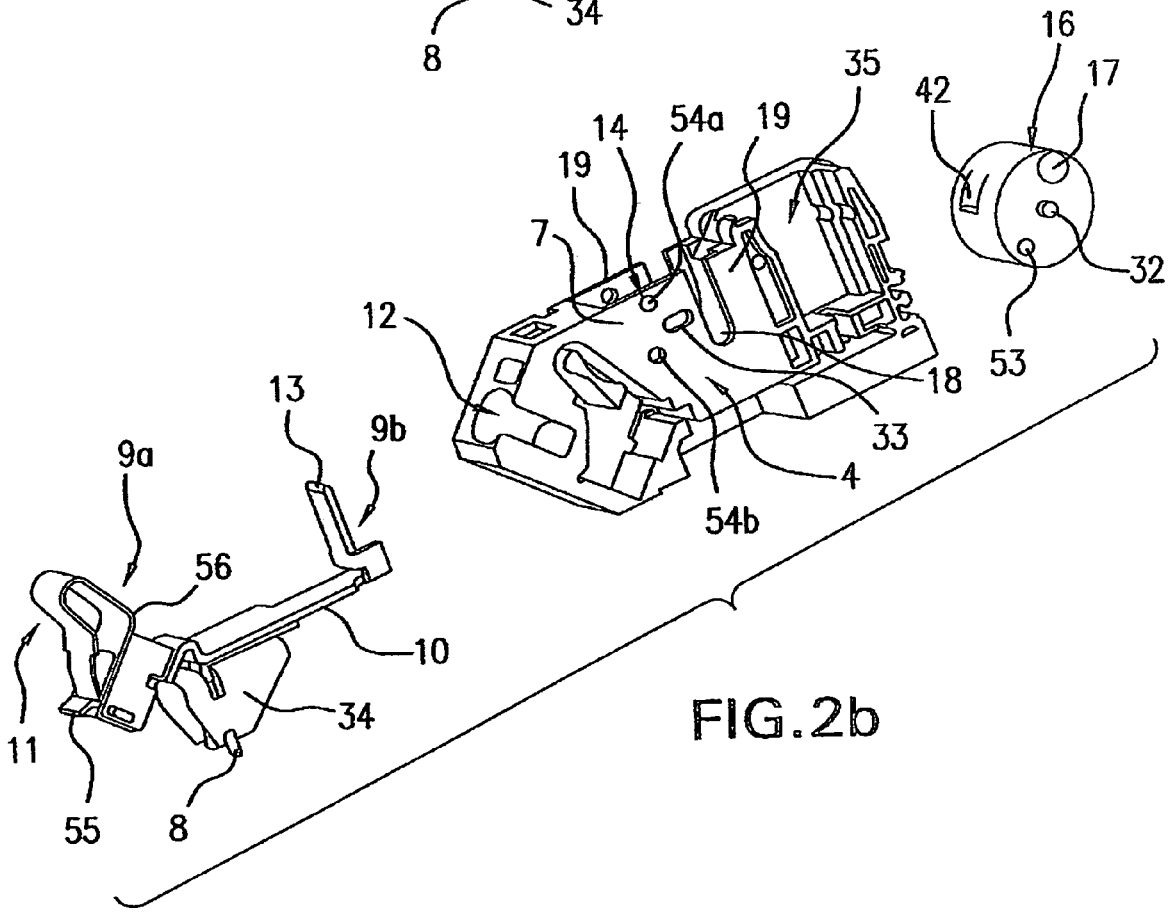

As shown in FIGS. 2*a* and 2*b*, each of the conductor piercing units 4 includes a hollow body member 7 having a bottom wall containing a recess in which is mounted a downwardly directed insulation piercing contact 8 that is supported by an inverted U-shaped conductive metal support member 34. The top surface of the body 7 contains first and second longitudinally spaced recesses 12 and 14, and a third recess 14 that is arranged between said first and second recesses and which defines a pair of spaced parallel side walls 19. A horizontal bus bar 10 is mounted within the body 7, said bus bar having first and second end portions 9*a* and 9*b* to which are respectively connected a resilient contact 11 arranged below the recess 12 and having relatively movable leg portions 55 and 56, and a plug contact 13 that extends upwardly into the second recess 35. Mounted for rotation within the third recess 14 is an operating disk 16 formed of a synthetic plastic material and having on its central axis a journal pin 32 the ends of which extend into opposed horizontal slots 33 contained in the body side walls 19. The operating disk contains an eccentrically located through bore 17 rotatably receives a support shaft 37 that extends through aligned vertical slots 18 contained in the body side walls 19. The support shaft 37 is rotatably received by all of the eccentric openings 17 of the disks 16, the ends of the shaft 37 being supported in openings 36 contained in the side walls 3*a* and 3*b* of the frame 3.

Figure 6:
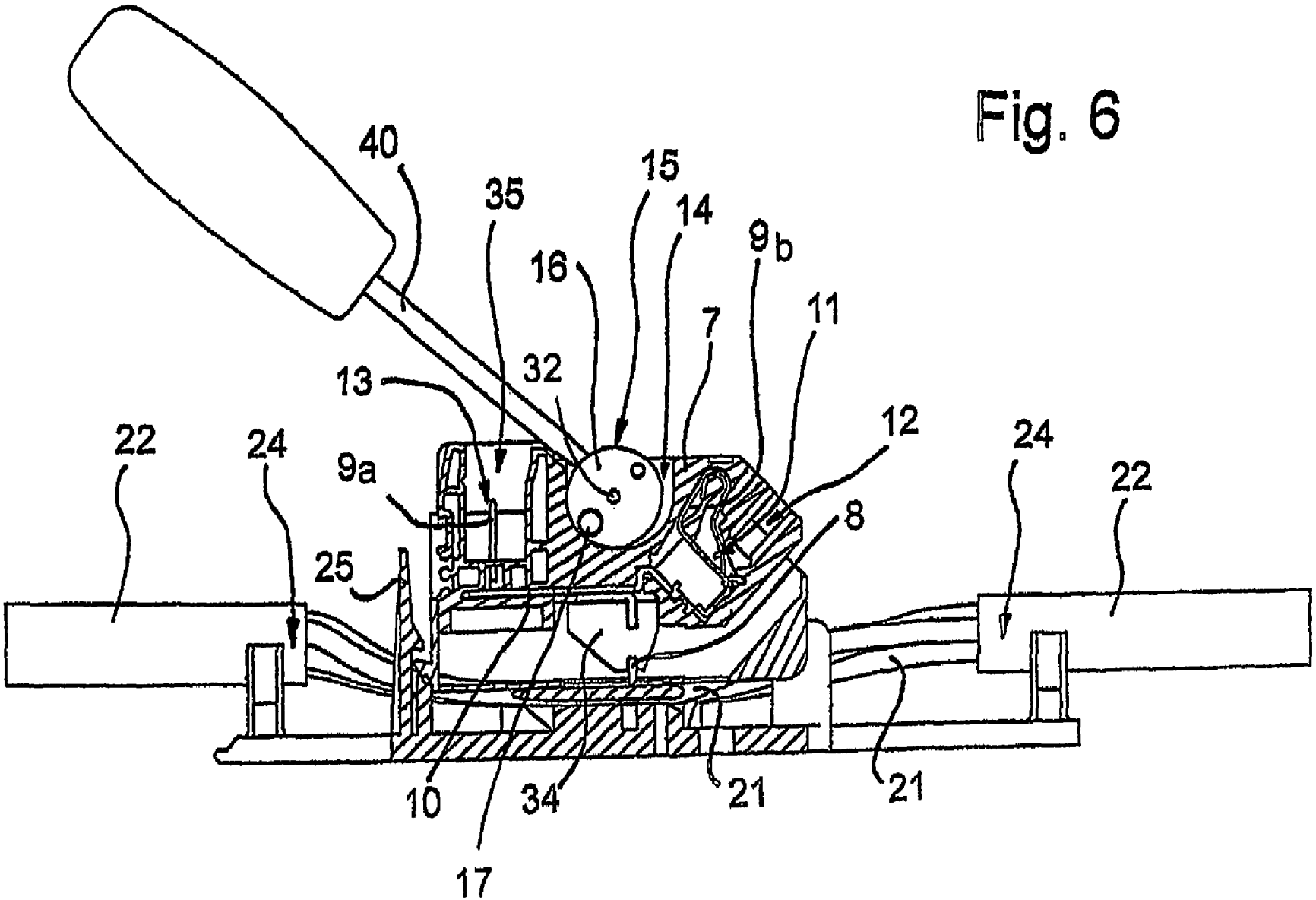
FIGS. 6 and 7 are longitudinal sectional views of the apparatus FIGS. 4 and 5, respectively.

As will be explained in greater detail below, each of the operating disks 16 contains in its outer circumferential surface an operating recess 42 that is adapted to receive an operating tool, such as the tip of a screwdriver 40 (FIG. 6). Furthermore, in order to provide audible position indicating means, each operating disk is provide with an eccentrically located projection that is operable to engage in a sound-producing snap operation correspond recesses 54 contained in the body side walls 19.

Figure 3:
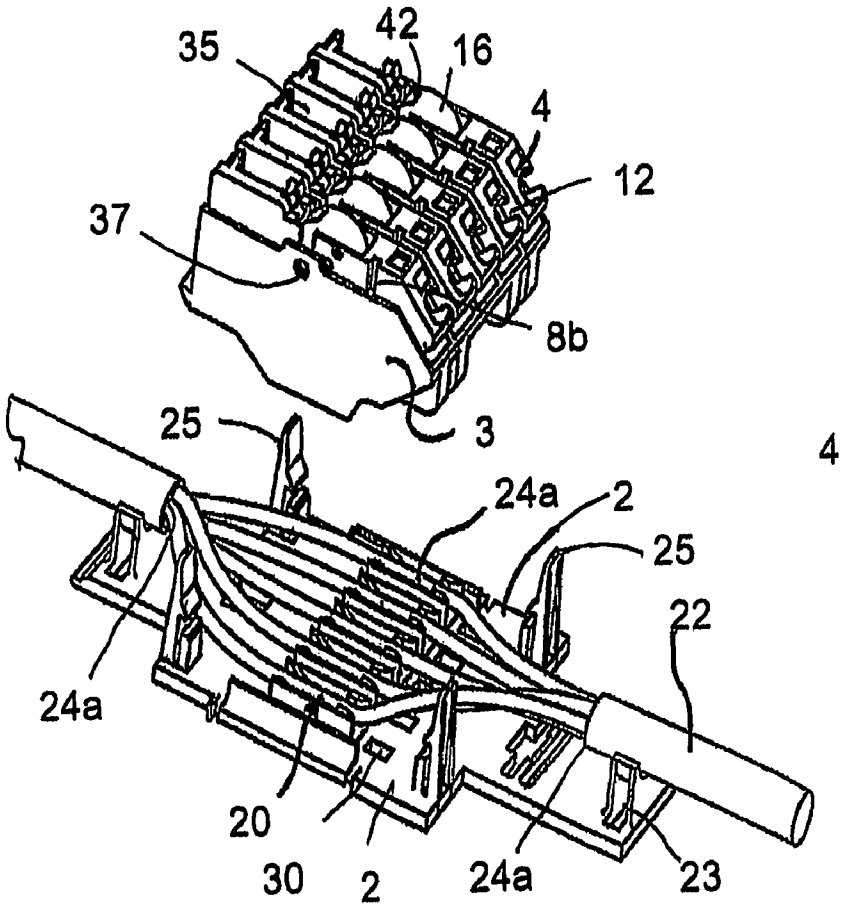
FIG. 3 is a detailed exploded view illustrating the snap-lock manner of mounting the module frame upon the conductor support plate.
Figure 4:
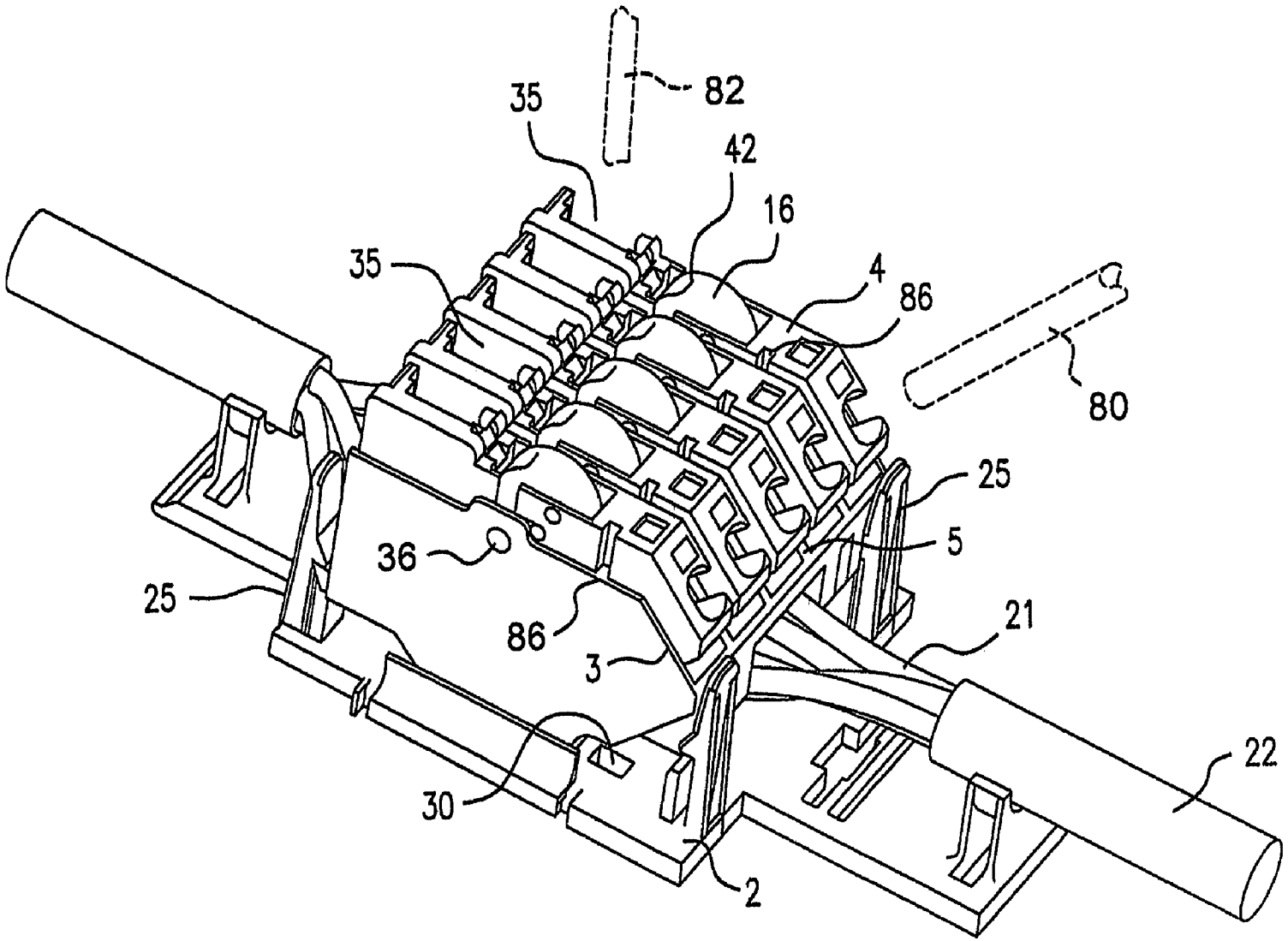
FIGS. 4 and 5 are perspective views illustrating the module fame mounted on the base plate with the connector piercing units in the elevated and lowered position relative to the module frame, respectively.
Figure 5:
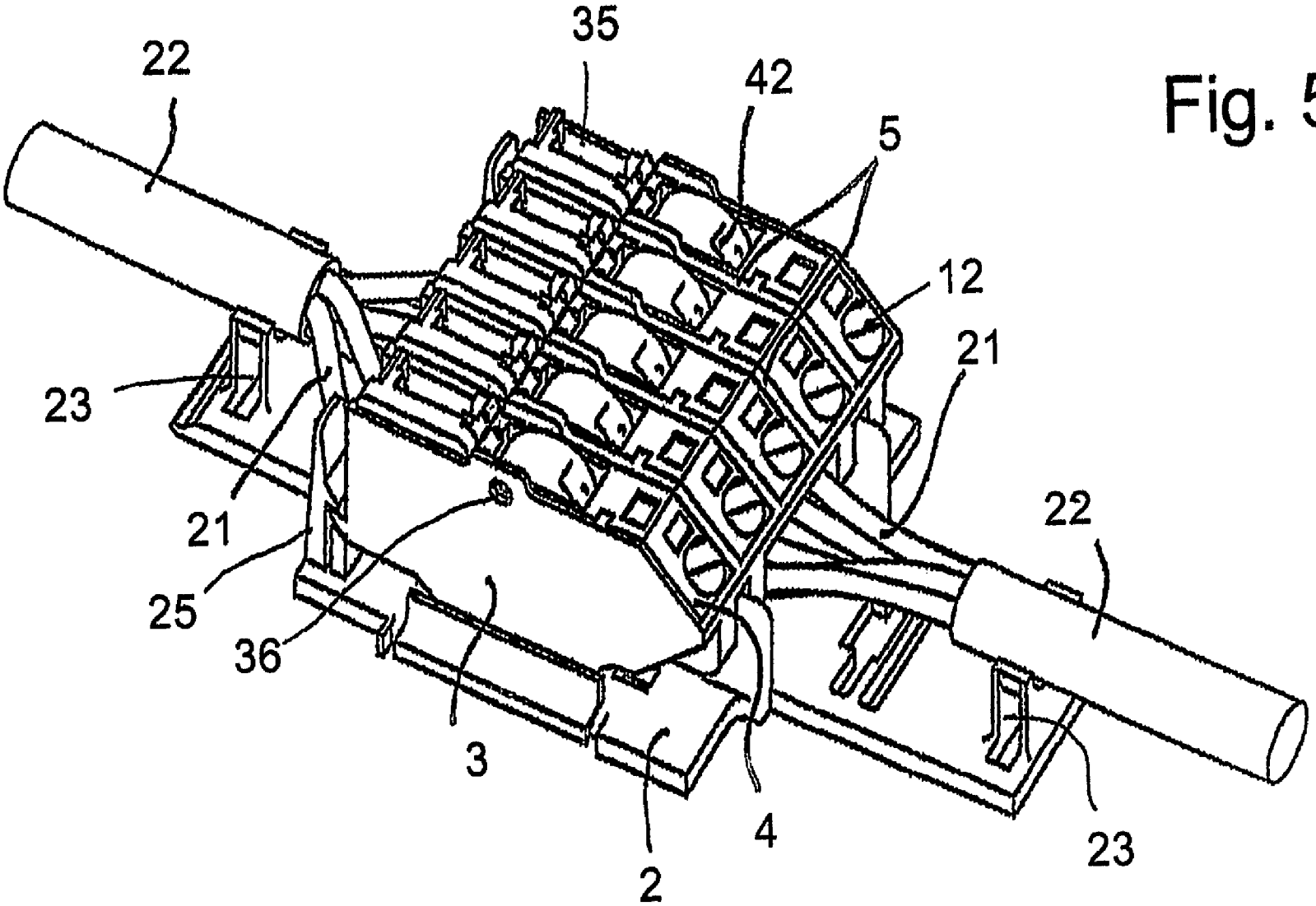
Figure 7:
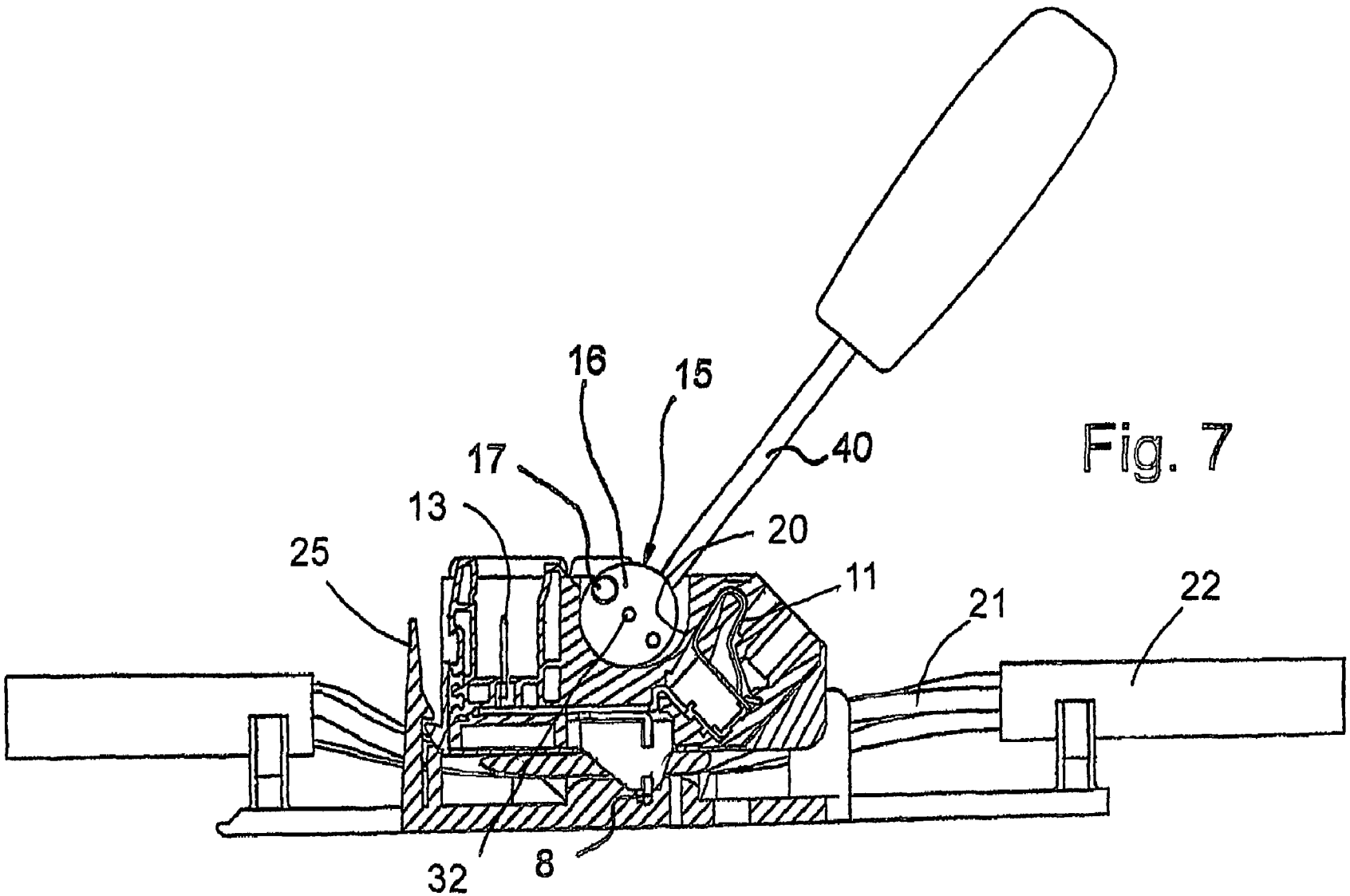

Referring now to FIG. 3, to assemble the connector system, the sheath layer is removed from a desired section of the cable, and the insulated conductors 21 of the stripped cable section between the sheath ends 24*a* are fanned-out in the horizontal plane and are arranged in their respective seats 20 on the base plate 2, whereupon the piercing unit assembly consisting of the frame 3 and piercing units 4 is connected with the base place 2 by the snap fit connections 25, thereby to produce the assembled condition of FIGS. 4 and 6. The operating disks 16 are in a position such that the corresponding piercing units 4 are in their elevated disconnected positions relative to the base plate 2 and the conductors 21 supported thereby. Branch line output conductors 80 and 82 are inserted into the openings 12 and 35 of the piercing units for engagement with the resilient contact 11 and the plug contact 13, respectively. When an the individual disk 16 is rotated about the shaft 37 that extends through the eccentric openings 17 by the manually operated tool 40, the disk also rotates about the central journal pin 32, whereby the cooperation between the disk 16 and the bottom wall 20 of recess 14, together with the cooperation between shaft 37 and the wall slots 18, caused the piercing unit 4 to be displaced downwardly in the frame to the connected position of FIGS. 5 and 7. This displacement of the piercing unit causes contact 8 to pierce the insulation layer of the associated conductor 21, and thereby to come into electrical engagement with the conductor. The conductor is now electrically connected with the two branch output conductors 80 and 82 via the bus bar 10 and the electrical contacts 11 and 13, respectively. Rotation of the disk 16 in the opposite direction causes upward displacement of the piercing unit to the disconnect position of FIGS. 4 and 6, whereupon the conductor 21 is disengaged from the output conductors 80 and 82. During the rotational movement of any operating disk 16 between the positions causing the associated piercing unit to be connected or disconnected from the insulted conductor 21, an audible position-indicting signals is produced as a result of the cooperation between the eccentric projection 53 and the corresponding recesses 54 contained in the body side walls 19.

The module frame could possibly also—not illustrated here—consist of a plurality of individual frames that are connected with each other, for example, in a locking manner, of which each might be shaped to receive, in each case, one of the conductor piercing disks. The branching connections 9 can basically be designed in any connection technique (IDC, screw, spring, etc.). Preferably, one uses compression spring contacts 11 (push-in), that can be wired directly without the use of any tools, for which compression spring contacts the insertion openings 12 are arranged on the top of the basic body 7.

The screwdriver 40, as the preferred actuation tool, here exerts a lever effect for secure wiring of the individual conductors on an individual basis. Of course, if the shaft 37 were to be mounted for rotation in the openings 36, and if all of the disks 16 were to be secured to the shaft, the disks could be rotated simultaneously as a unit to effect simultaneous engagement between all of the piercing contacts 8 and the associated conductors 21.

The frame fastening devices 25 in this case comprise four snap bridges that can be locked in a snapping manner upon module frame 3, after the latter has been downwardly upon the base plate 2. Other kinds of assembly and fixing means are also possible (for instance, it is conceivable to fix the module frame or the entire pre-assembled connection module in a rotatable fashion upon the bottom plate and then to swing it up upon the bottom plate 2 and to lock it only on one side (see FIG. 5) or to fix it by means of a screw, a clip, or an elastic ribbon or the like upon bottom plate 2 (not shown)).

Base plate 2 also contains a plurality of inspection penetrations 30 that make it possible to check whether the conductors 21 lie correctly in their seats 20. Although a round cable 22 is shown here, one can also make use of a flat cable as well.

The connector arrangement is quite simple and can be operated in an easy and safe fashion, whereby one can apply particularly strong wiring forces via the eccentric arrangement, which is supported on the module frame. During the wiring operation, the bottom wall 20 of recess 14—in which is arranged eccentric disk 16—serves as abutment in order to press the connection disk 14 as well as IDC contact 8 upon conductor 21 which is to be contacted.

It is conceivable as an alternative that the conductors could be wired by groups if, in place of the preferably proposed eccentric disks, as actuation device, one were to use an eccentric disk roller that would extend over several operating disks. However, the design with the individually wireable connection disks is preferred because it facilitates more flexible handling.

It is desirable to put the arrangement of FIG. 1 in a support housing although it can also be used, for instance, for direct assembly in a switch cabinet. Referring to FIGS. 8-11, such an open-topped support housing 26 with a lid or cover member 27 and several passages 28 for the cable—to be used in an optional manner—as well as openings 28 for outgoing conductors (not shown) is illustrated. In the area of the openings 28, wall portions 39 are provided that can be separated along designated fracture lines 41 in order to cope with the most varied installation situations (FIG. 9). A preferably slit seal 47 will seal off the passages or the openings for cable 22. In this way, this support housing can be employed universally in the most varied installation situations. The support housing can also be designed to receive several connection systems and modules and in this case, for example, it can have partitions. It is furthermore also conceivable to put several connection modules upon one base plate.

Figure 8:
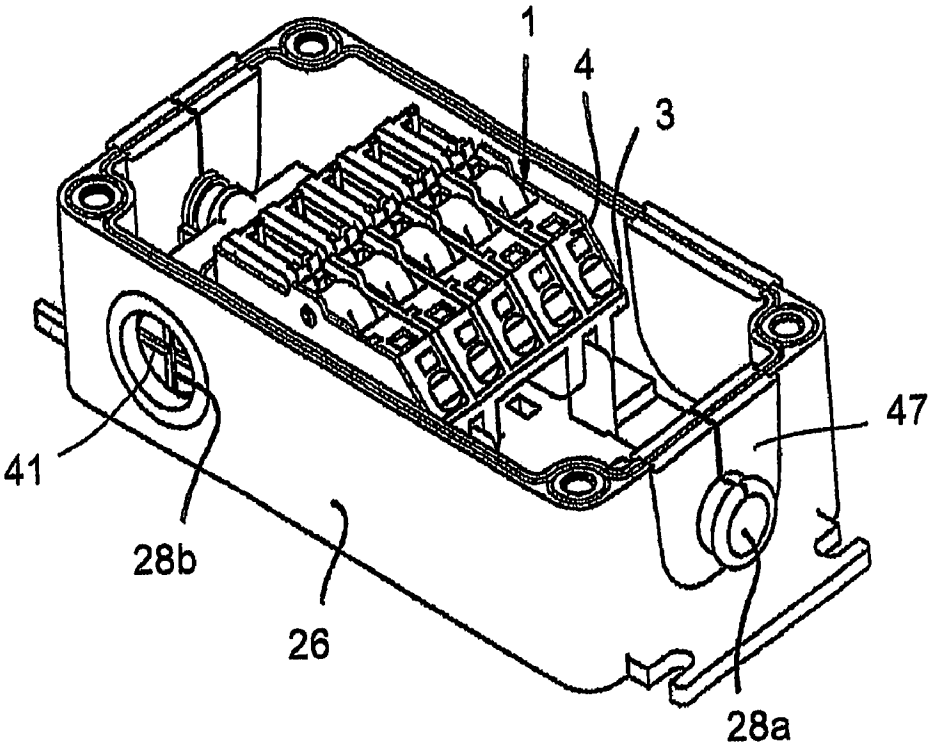
FIG. 8 is a perspective view of the apparatus of FIG. 4 contained in an open-topped outer housing.
Figure 10:
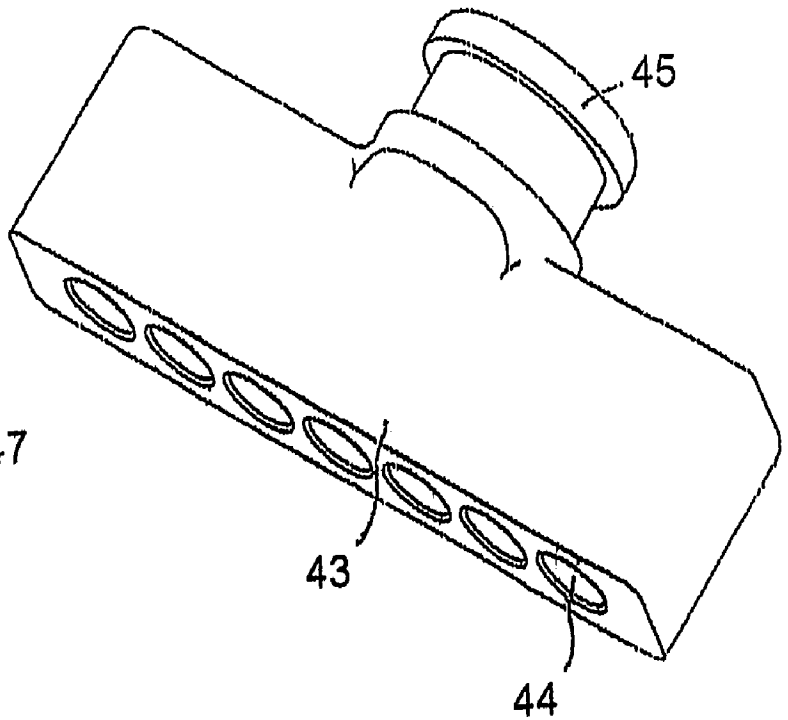
FIG. 10 is a perspective view of a flat terminal housing suitable for use with the connector apparatus of the present invention.
Figure 9:
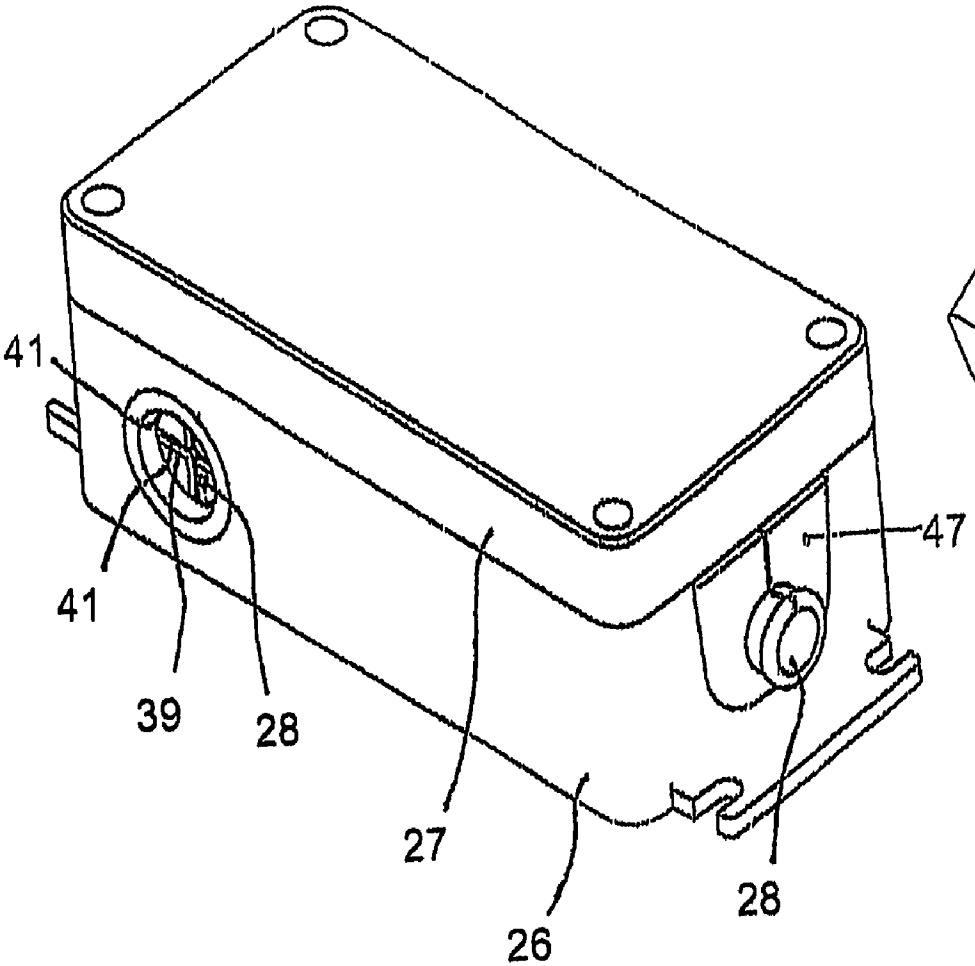
FIG. 9 is a perspective view of the apparatus of FIG. 8 provided with a cover member.
Figure 12:
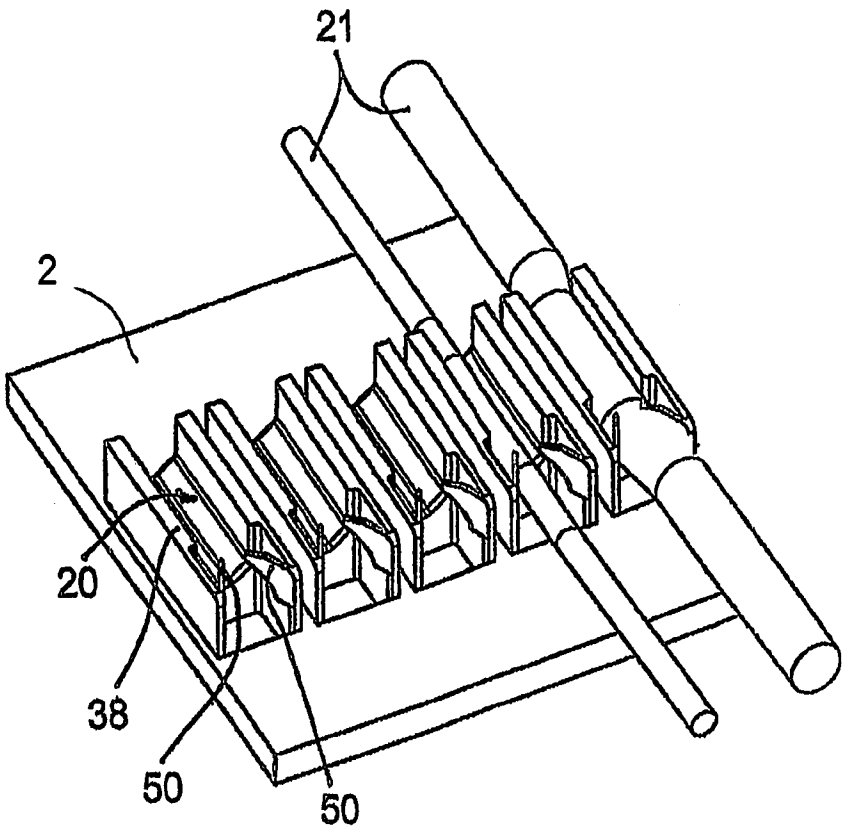
FIG. 12 is a perspective view of the conductor support plate of FIG. 1, and FIGS. 13 and 14 are perspective views illustrating two modification of the conductor support plate of FIG. 12.

FIG. 10 shows a terminal element 43 for insertion, for instance, in the support housing of FIG. 8, if the latter is arranged at the free end of cable 22, which has a number of chambers 44—preferably corresponding to the number of conductors 21—for insertion of the free conductor ends, which are so designed that one can securely avoid leak currents 8 and the like. A ring catch 45 is used for fixing in the mounting.

Figure 11:
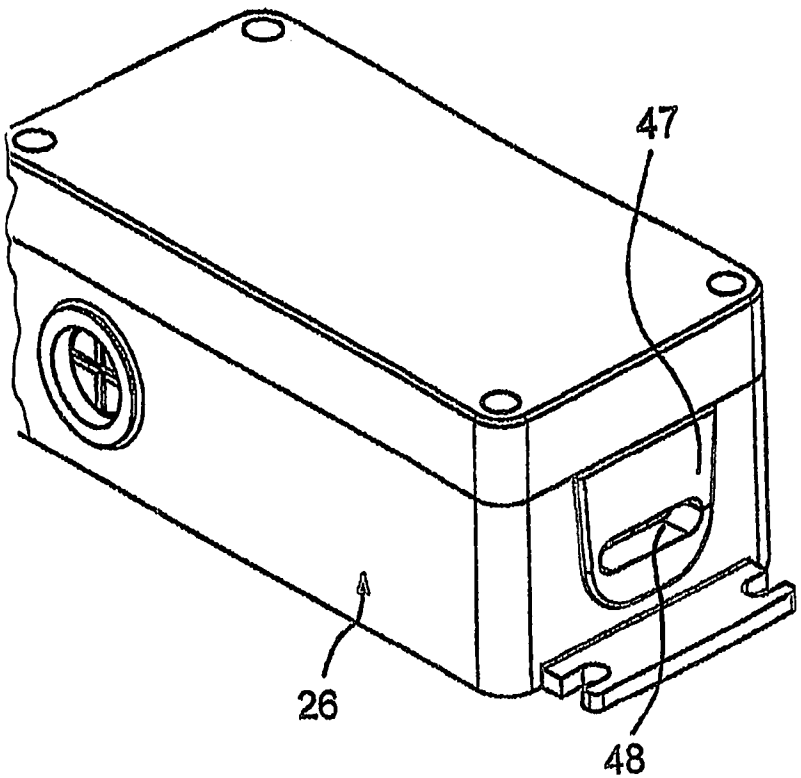
FIG. 11 is a perspective view of a modification of the housing of FIG. 9.

An alternate design of a support housing 26 that is designed to receive a flat cable instead of a round cable is illustrated in FIG. 11. For this purpose, the seals 47 (preferably made as a whole or partly divided) of the support housing 26 are provided in each case with a flat penetration 48 instead of a round penetration 49 for cable 22 (see FIG. 8).

If no support housing 26 is used, then one can also conceive of a direct assembly of the base plate 2 upon a plate or the like in the switch panel box (not shown). The seats 20 for conductors 21 in this case are made up of two bridges 38 that are so designed that they can be inserted in conductors 21 having different diameters. For instance, to the side of the outermost bridge 38, one can place additional conductors of the cable upon which conductors no branches are required (see FIG. 1).

FIGS. 12 to 15 show portions of modifications of the base plates 2. Bridges 38 of the seats are in each case provided with catch hooks 50 for retention or locking of the conductors in the seats.

Figure 13:
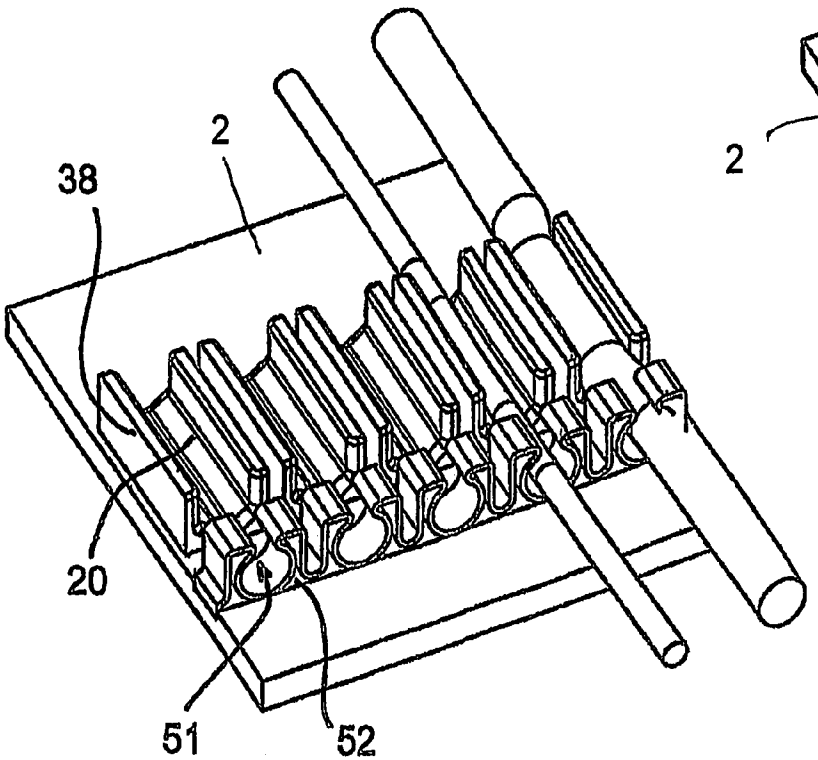
Figure 17:
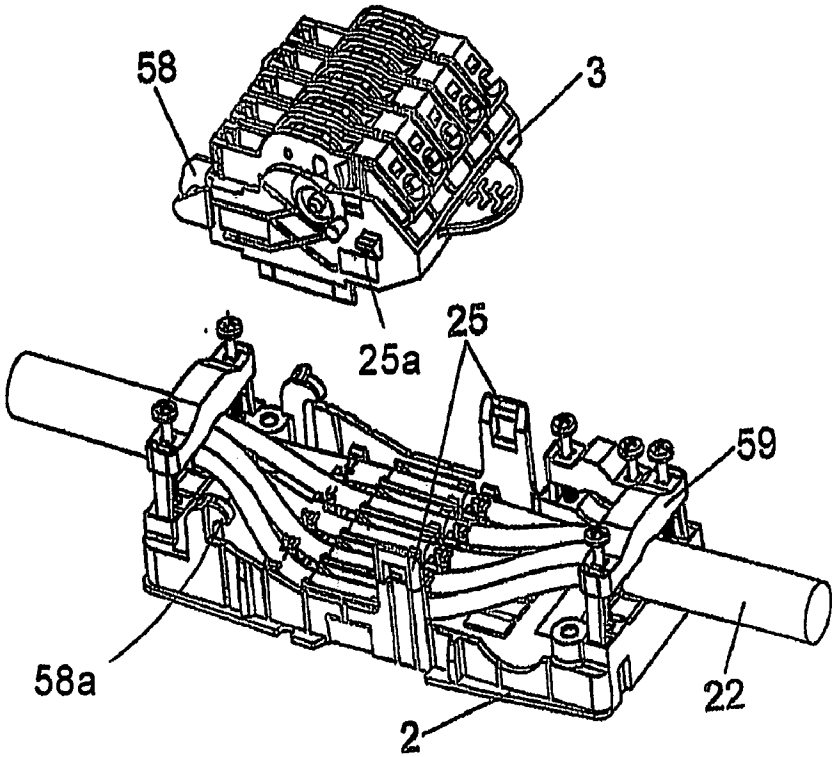
FIG. 17 is a perspective view illustrating the manner of mounting of the connector module onto the support plate and conductor assembly.
Figure 15:
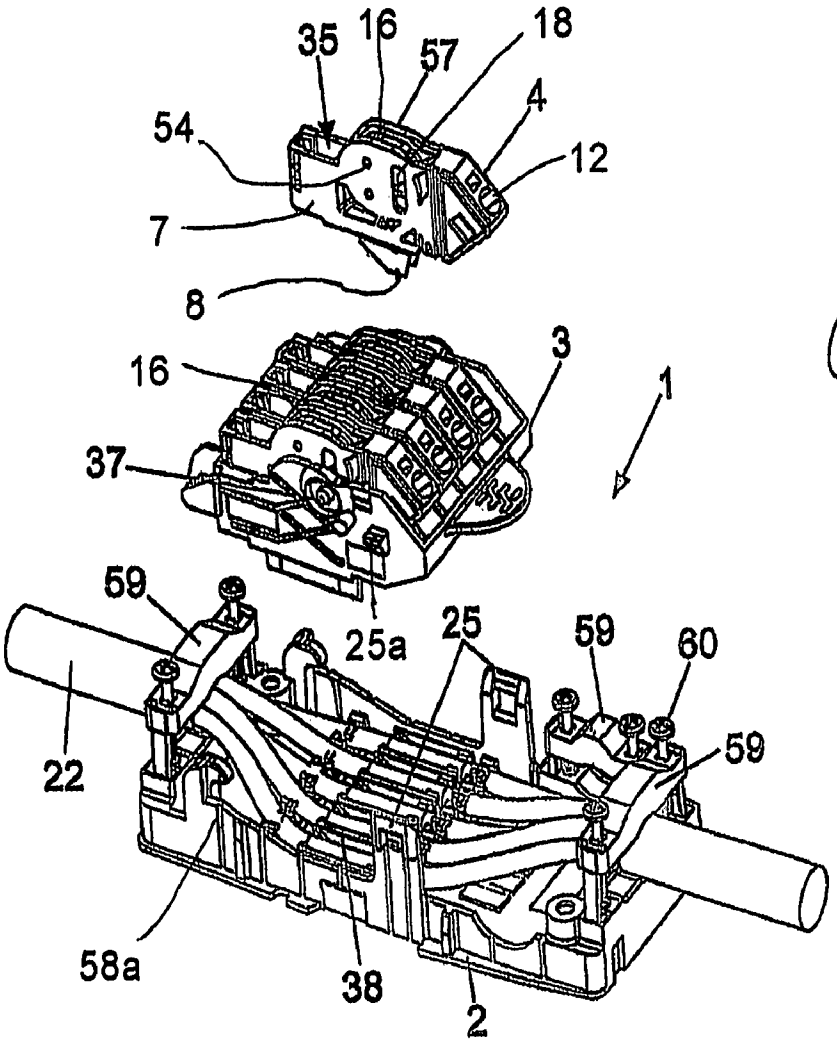
FIG. 15 is an exploded perspective view of a second embodiment of the connector apparatus of the present invention.
Figures 16A, 16B:
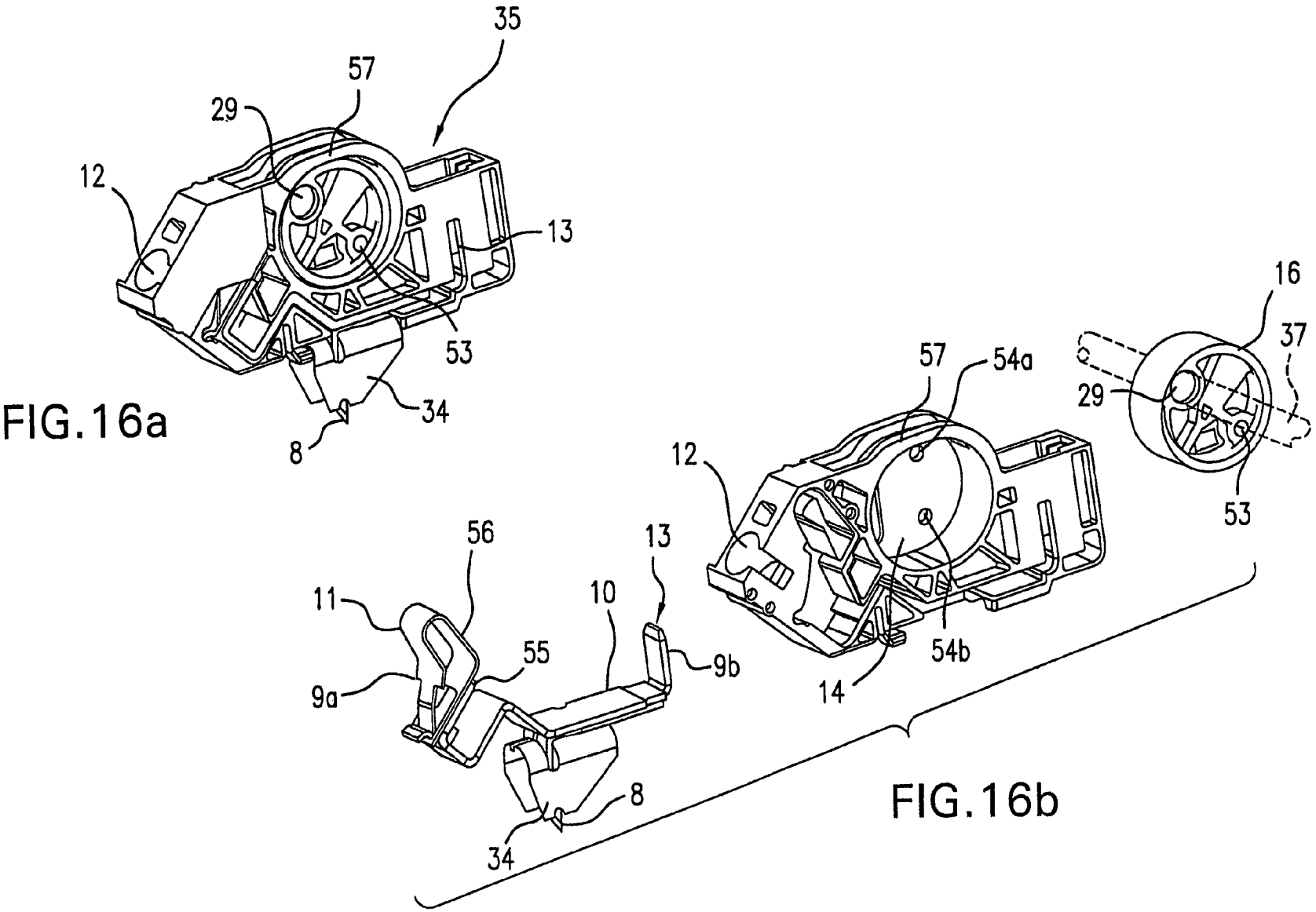
FIGS. 16*a* and 16*b* are perspective and exploded perspective views of the connector piercing unit of FIG. 15.
Figure 18:
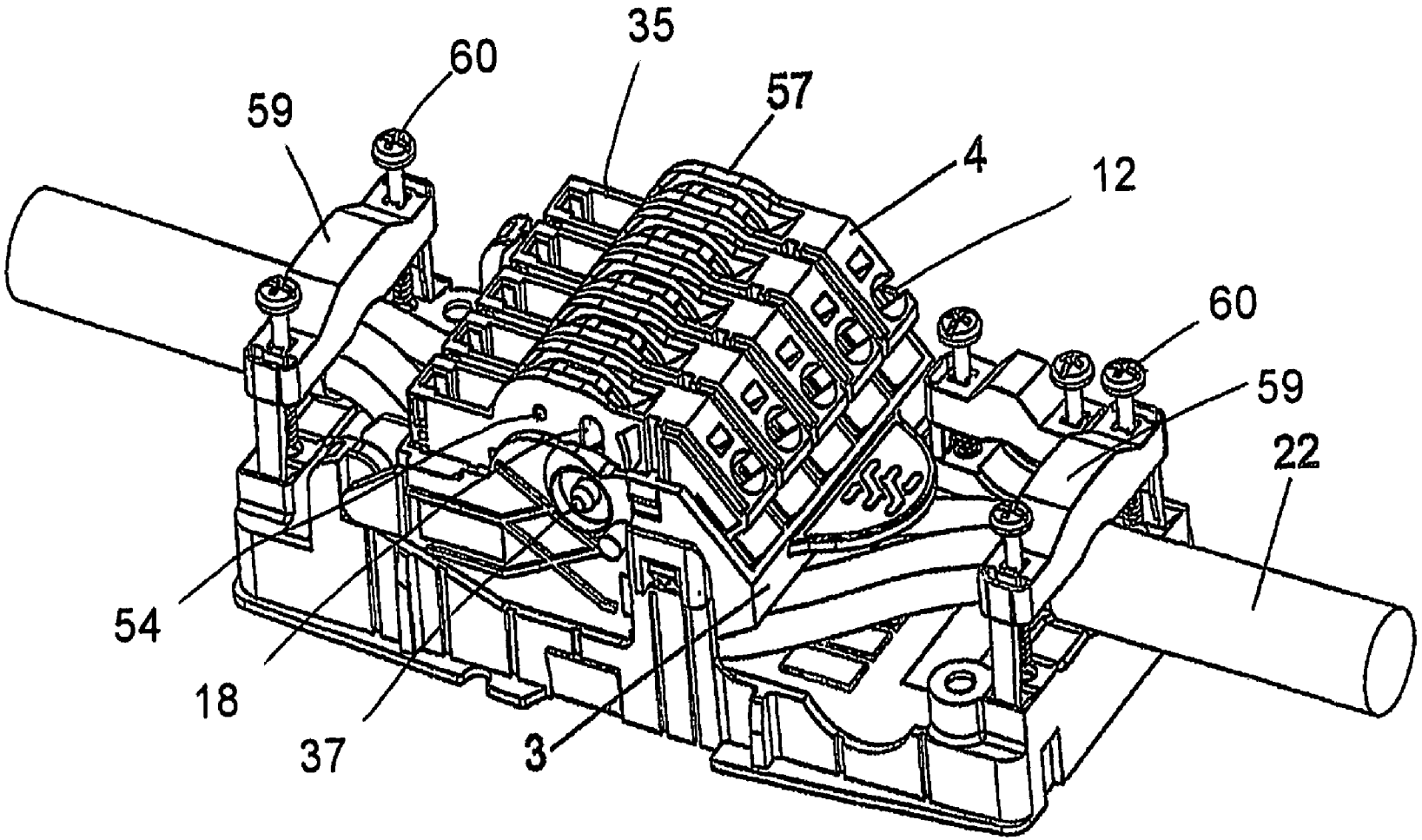
FIGS. 18 and 19 are perspective views illustrating the assembled apparatus with the piercing units in the disengaged and engaged positions, respectively.
Figure 19:
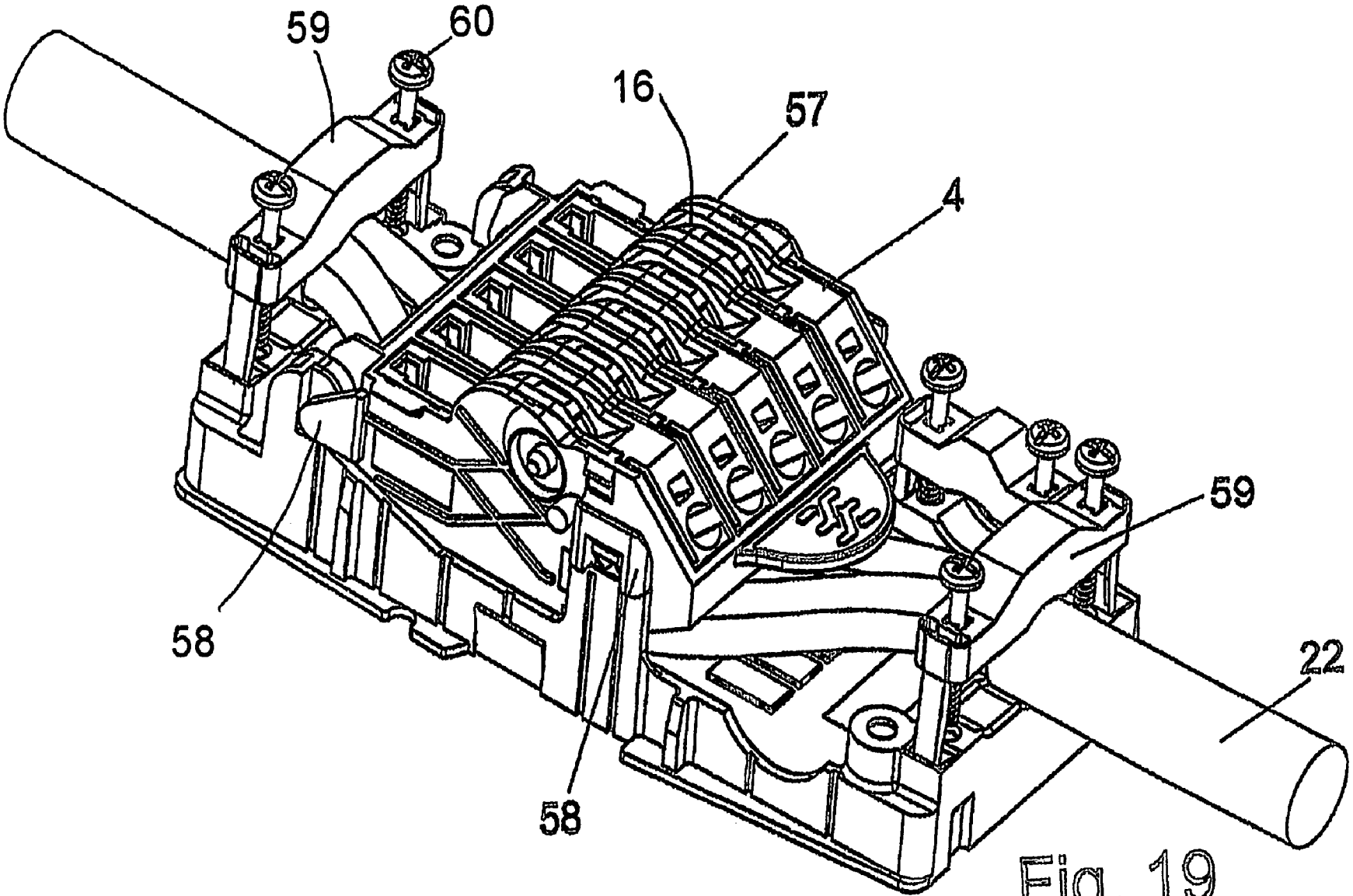
Figure 20:
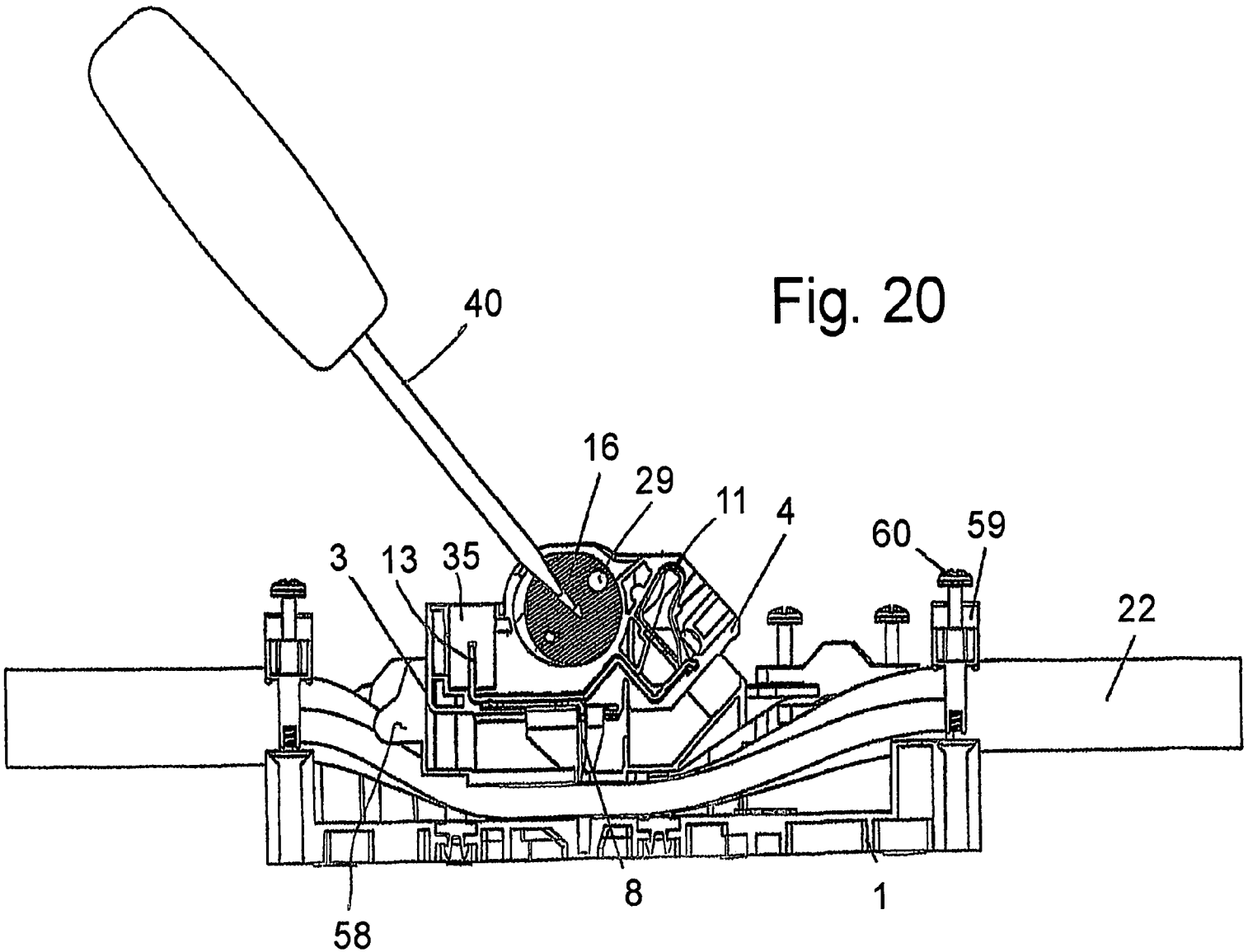
FIGS. 20 and 21 are corresponding longitudinal sectional views of the apparatus of FIGS. 18 and 19, respectively.
Figure 21:
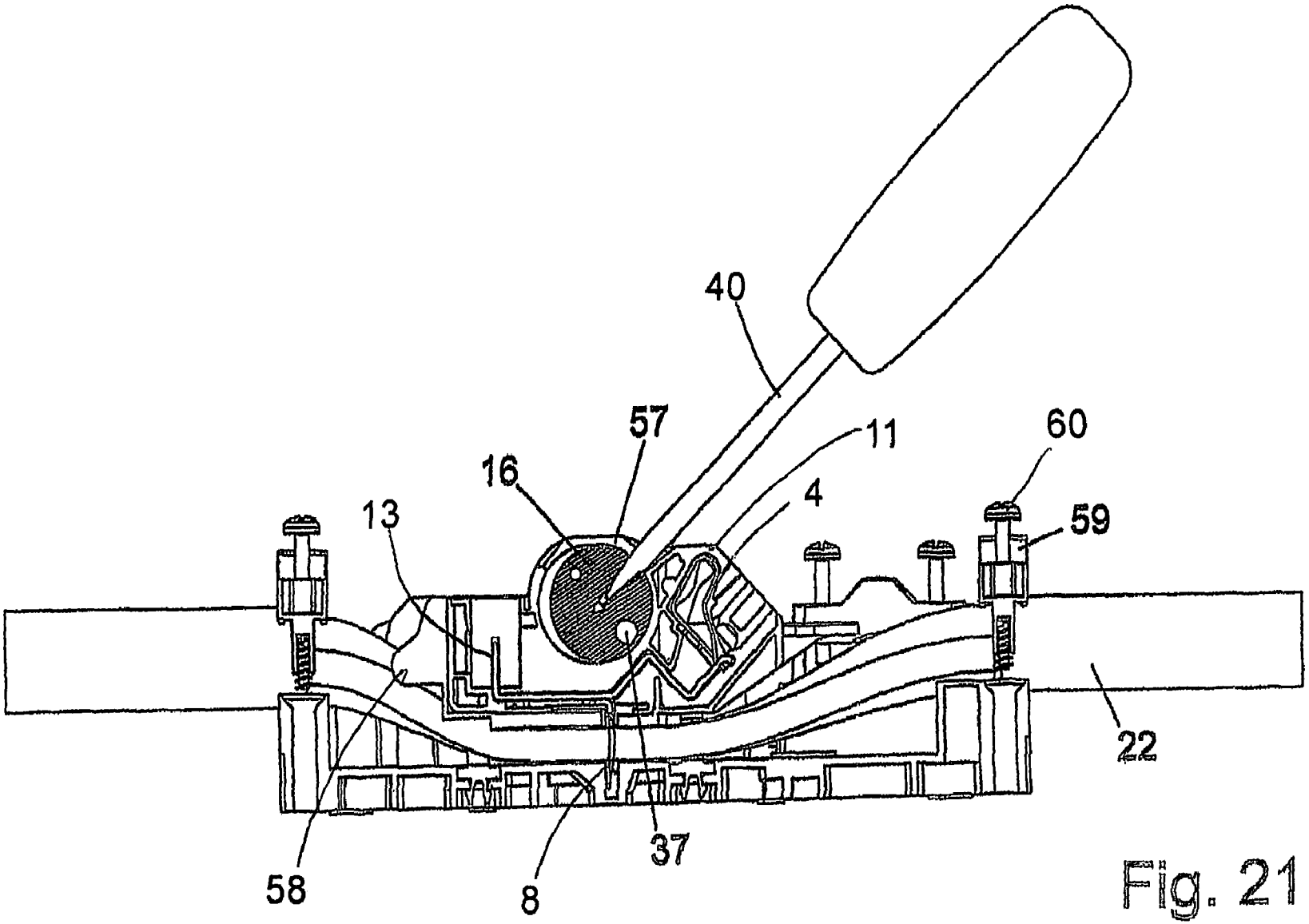
Figure 23:
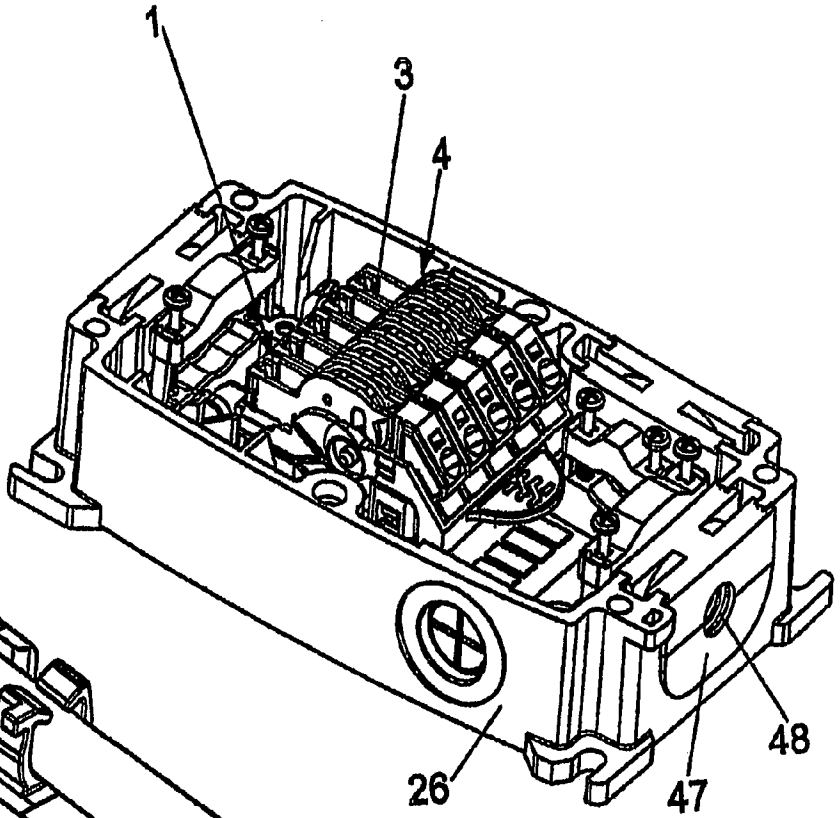
FIGS. 23-25 are perspective views of various outer housing embodiments.

According to FIG. 13, separate catch seats 51 are provided by way of extension of the seats 21, which catch seats are made on a bridge 52 that is inserted in the bottom plate or that is also fastened upon the latter. This offers the advantage of being able to make the catch seats 51 from a specially selected elastic material, in particular, from a material other than the material used in the base plate.

Figure 22:
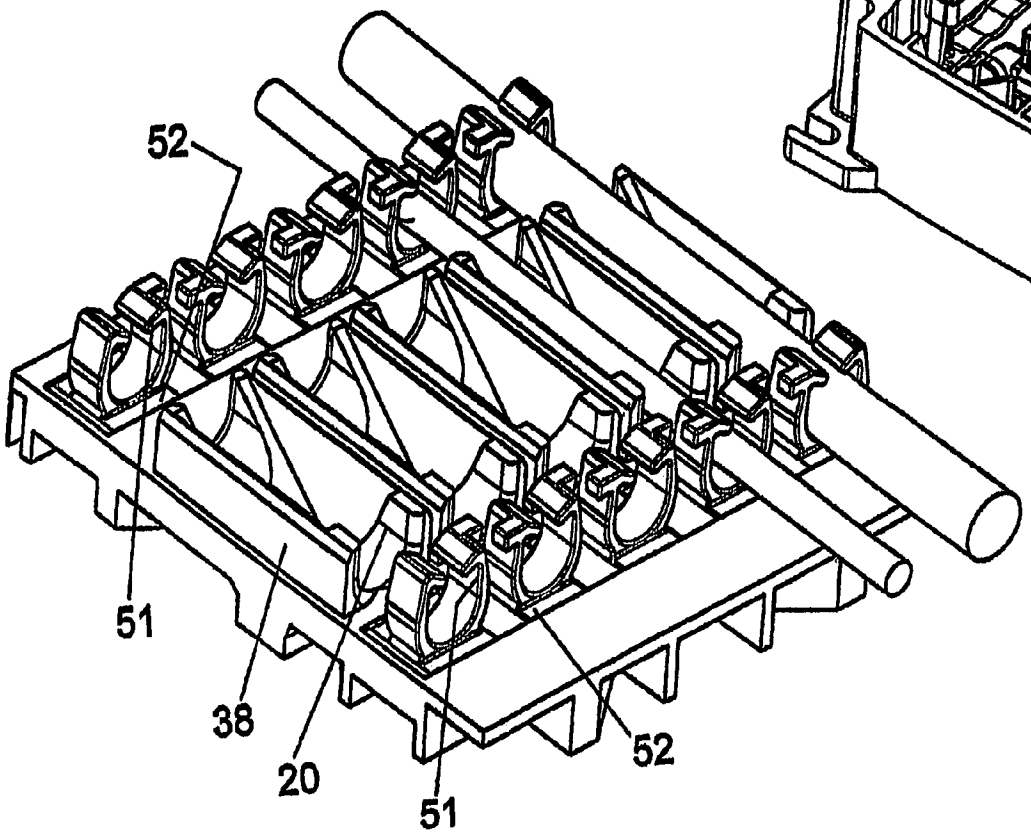
FIG. 22 is a perspective view of a base conductor support member including a first embodiment of conductor fastening means.

FIG. 22 shows a variant of this design where, on both sides of the seats 21, there are provided separate, spring-ring-like catch seats 51 that are made in each case upon one of the bridges 52. The latter again are inserted in the bottom plate 2. In that way, the conductors can be fixed advantageously on both sides of the contacting area. The catch seats 51 can be made of a specially selected elastic material.

Figure 14:
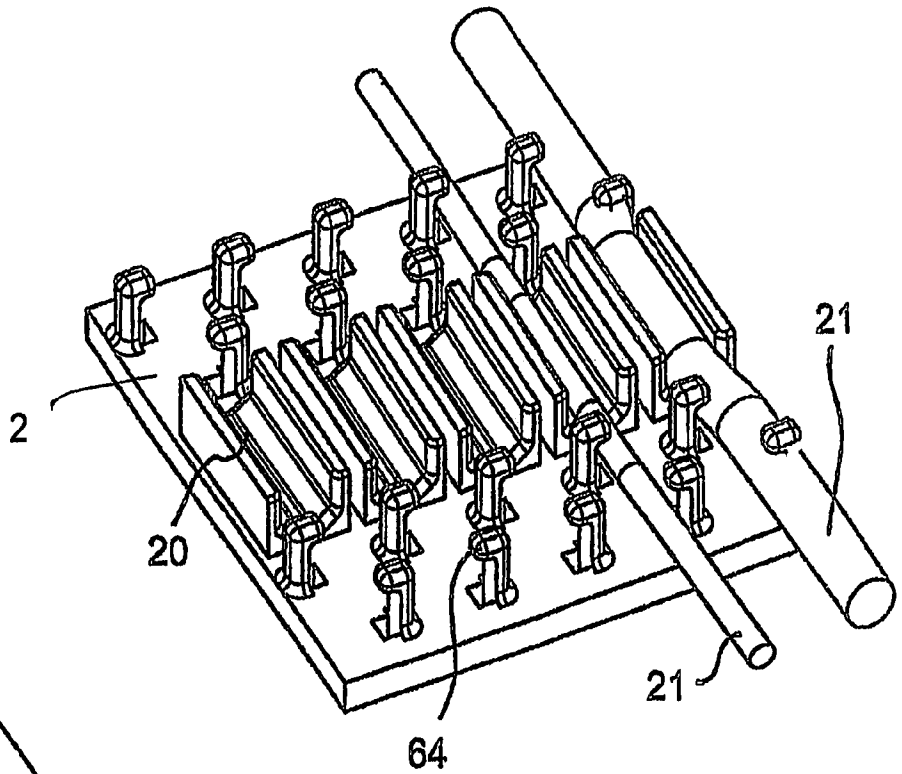

In FIG. 14, catch bridges 64 are made on base plate 2 and are arranged in a labyrinth or serpentine fashion in extensions of seats 20, which catch bridges likewise serve for locking the conductors 21.

FIG. 15 to 22 show another connector system 1 with a base plate 2 and the connection assembly, that can be set upon the base plate, with the module frame 3, in which one can insert a plurality of connection disks 4. The structure of this variant extensively corresponds to the structure of the embodiment according to FIGS. 1 to 8, and similar reference numerals have been used in the drawings.

Figure 26A:
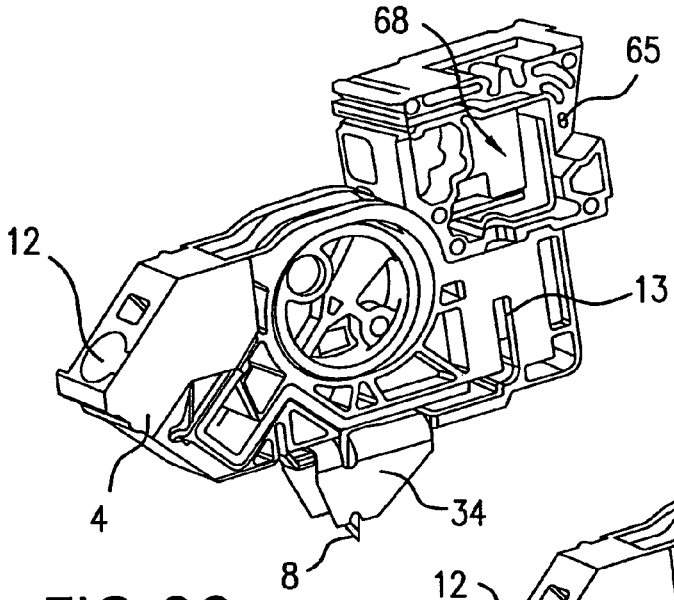
FIGS. 26*a*, 26*b* and 26*c* are perspective views of a second embodiment of the conductor piercing unit when in the partially disassembled, completely assembled, and exploded conditions, respectively.
Figure 26B:
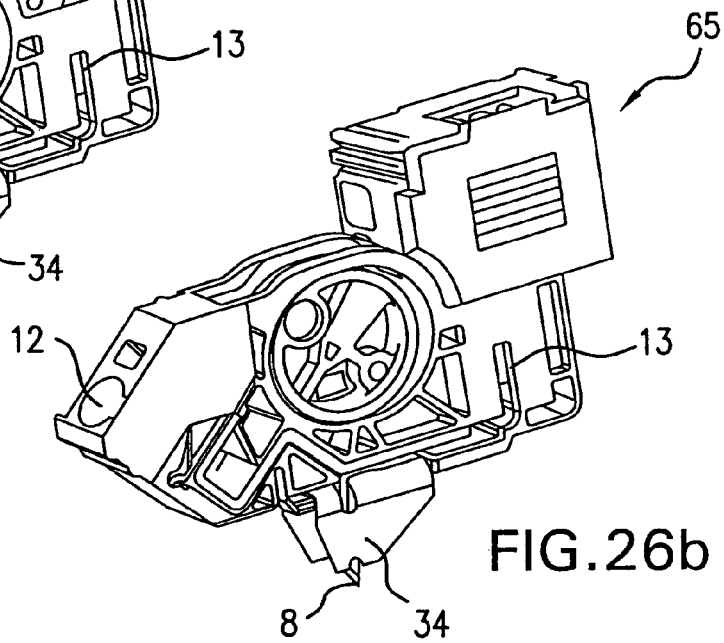
Figure 26C:
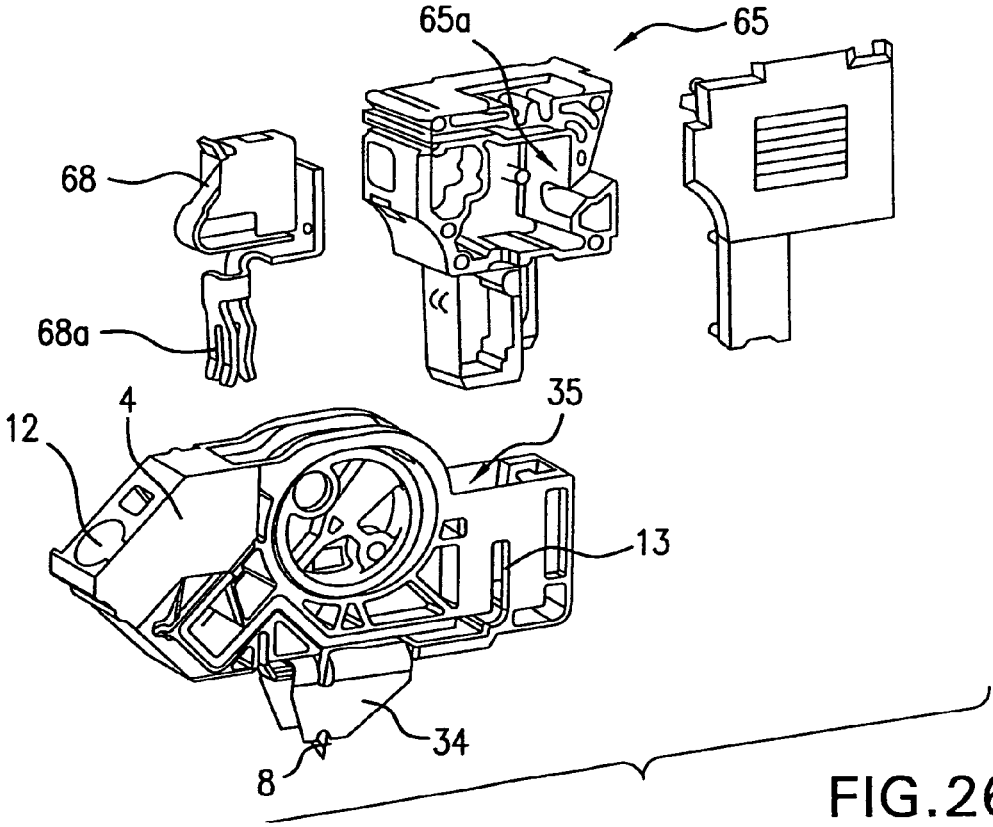
Figure 27B:
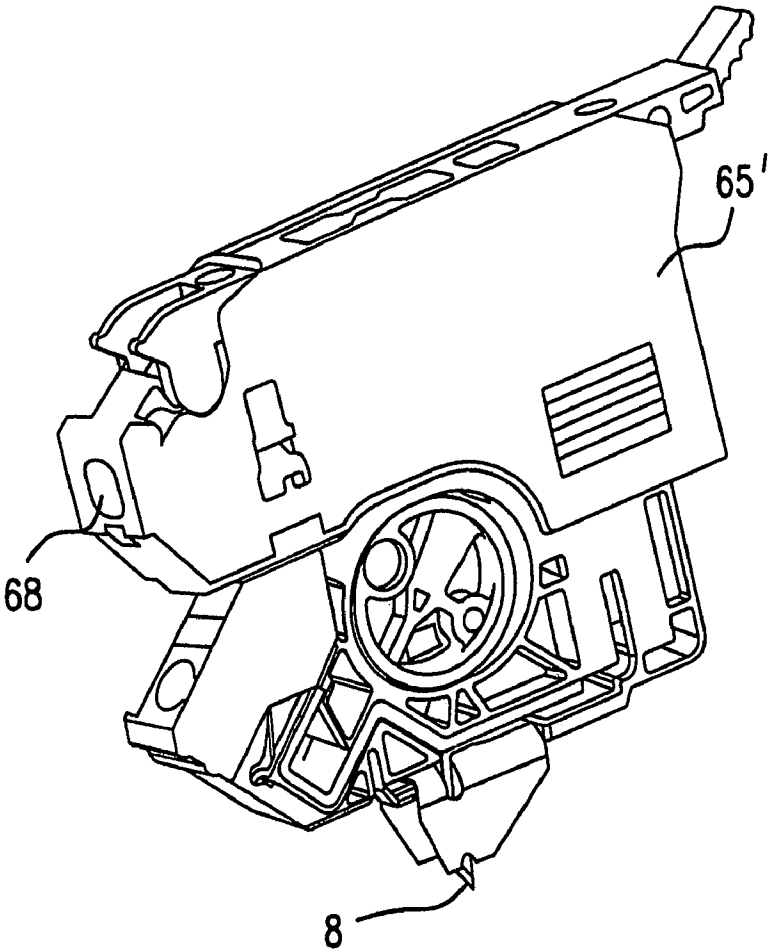
FIGS. 27*a*, 27*b* and 27*c* illustrate a third embodiment of the connector piercing unit when in the partially disassembled, completely assembled, and exploded conditions, respectively.
Figure 27A:
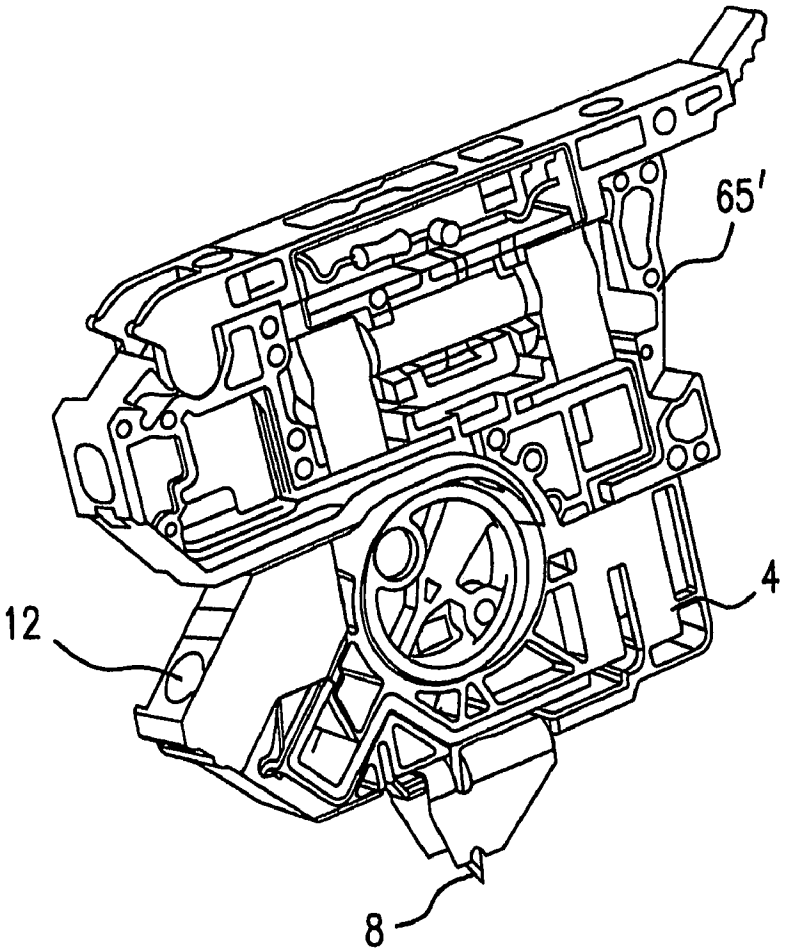
Figure 27C:
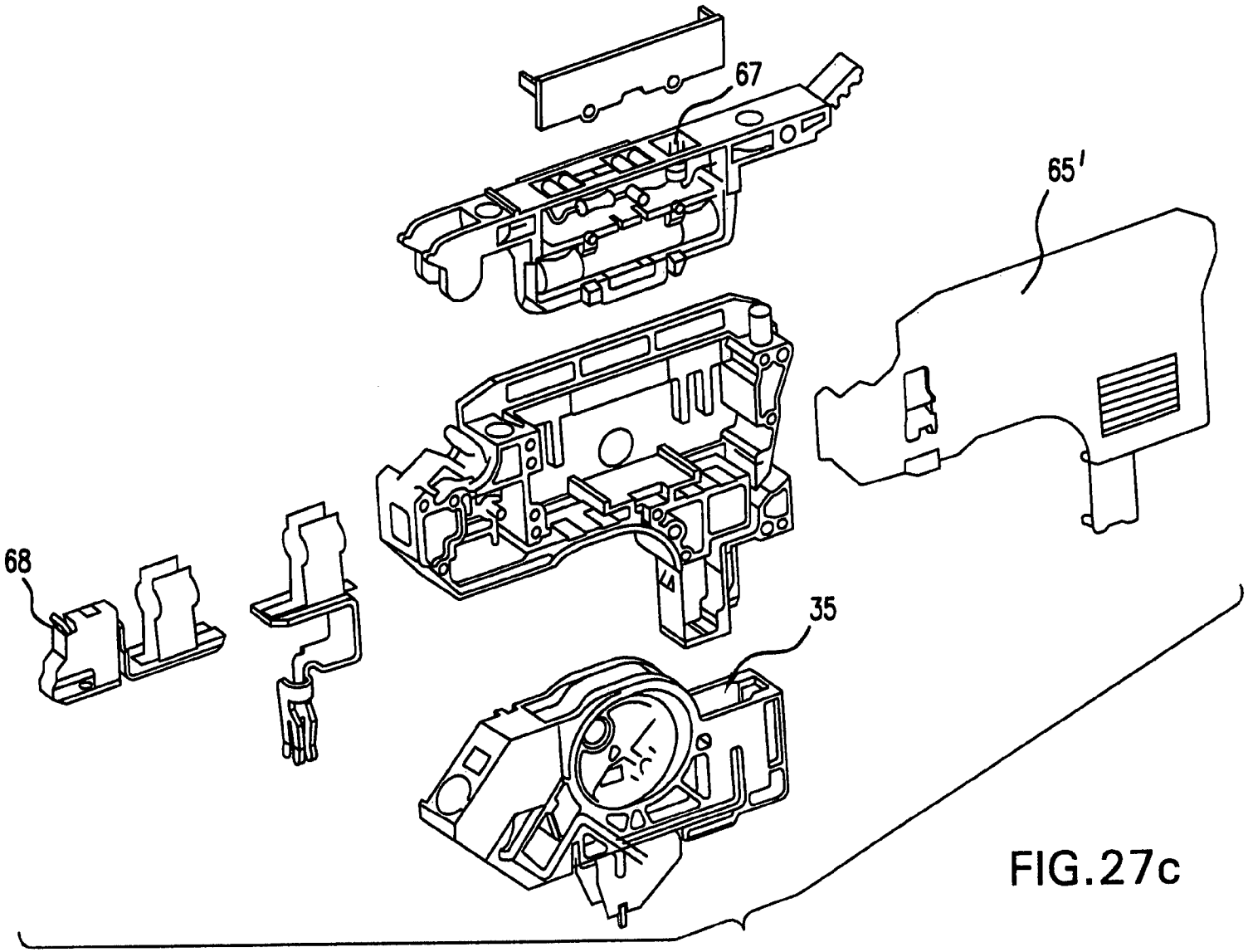

The conductor insulation piercing units 4 again in each case have a rectangular basic body 7 consisting of insulating synthetic plastic material. Upon each basic body 7 there are provided again the insulation-penetrating contacts 8, preferably as fork contacts, with the U-shaped support 34, and at least one or several conductively connected branch connections 9 for the connection of at least one branching tap off output conductor. One of the branch connections 9 from the bus bar 10 is here again a directly wired resilient bent spring contact 11 whose bus bar 55 is bent directly out of the bus bar section 10. The second branching connection here again is made as plug contact 13 in a recess 35 for putting on a corresponding connection plug 65 (FIGS. 26 and 27) with a socket 66, which plug can also display according to FIG. 27, electrical or electronic structural elements 67 and/or again additional conductor connections 68.

The actuation devices 15 again display operating disks 16 containing eccentric through openings 17. In the basic body 7 there are furthermore again provided the slots 18 in the side walls 19 on both sides of recesses 14, whereby the connecting slots 18 and the eccentric bearing openings 17 here again are penetrated by a continuous shaft 37 which extends through the entire module frame 4 and which pass through support openings 36 contained in the side walls and partitions of the module frame (see FIGS. 15 and 16).

The abutment for final wiring is made up here of two housing bridges 57 that are made above the operating disks 16. During wiring, the base of recess 14—in which is arranged eccentric disk 16—again serves as abutment in order to press the connection disk 4 as well as IDC contact 8 upon conductor 21 that is to be contacted. The additional projection 53 on eccentric disk 16 again is used for engagement in catch holes 54 in the connection disk, to make the wiring and final wiring detectable and to render its attainment audible.

Here again the base plate is provided with fixing devices 25 in order to attach the module frame upon the bottom plate after the insertion of the conductors. The fixing devices here comprise two snap-on bridges 25 which can be locked upon module frame 3, after the latter has been pivoted upwardly relative to the base plate, by means of pivot catches 58 that perform a pivot bearing function and that can be inserted in corresponding recesses contained in base plate 2. This type of assembly is particularly simple and safe.

Fixing means—which are made as cable straps 59 with screws 60—are provided here for the purpose of fixing the continuous unstripped areas of the cable shortly before or upon the sheath ends 24 of cable 22.

Figure 25:
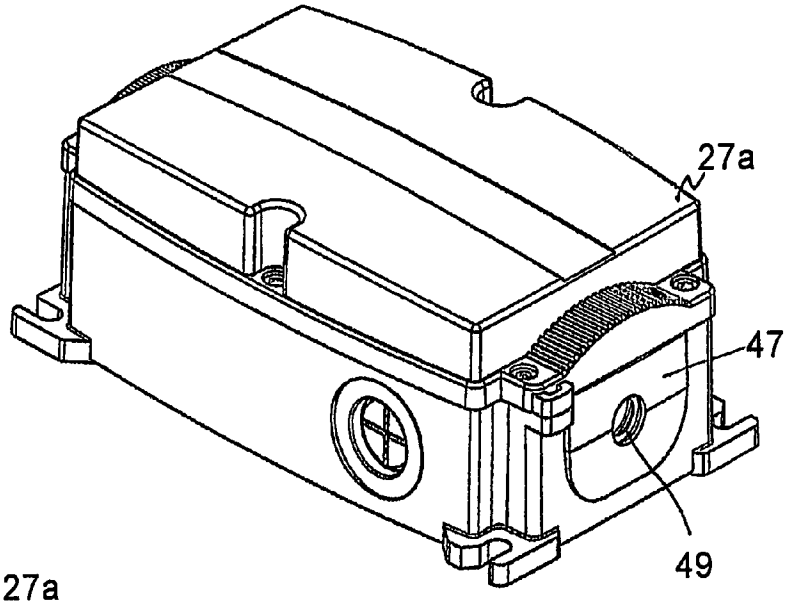
Figure 24:
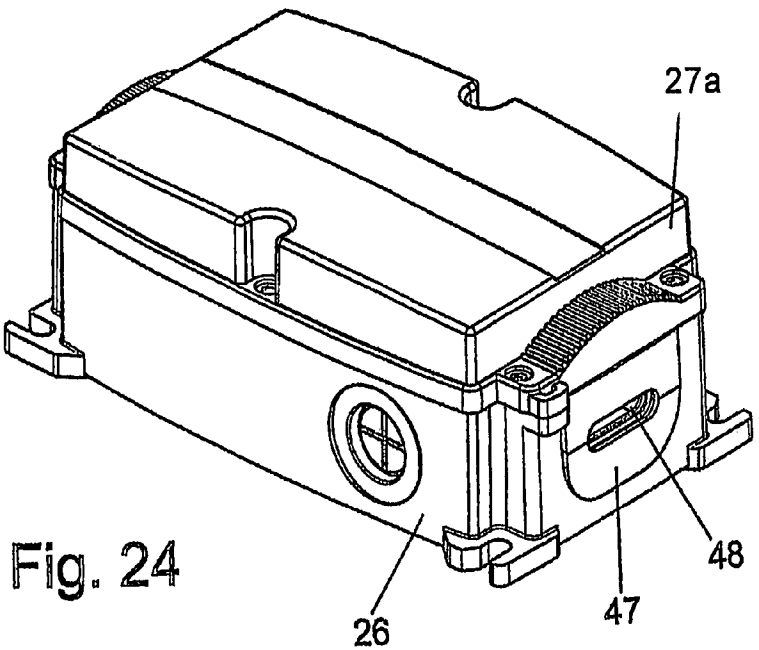

FIGS. 24 and 25 show additional cover housings with seals 47 for flat or round cables. These support housings can also be employed universally in the most varied installation situations. The support housing can also be designed to receive several connection systems and modules and for this purpose it can for example have partitions. It is further-more also conceivable here to place several of the connection modules upon a correspondingly shaped bottom plate.

Figure 28B:
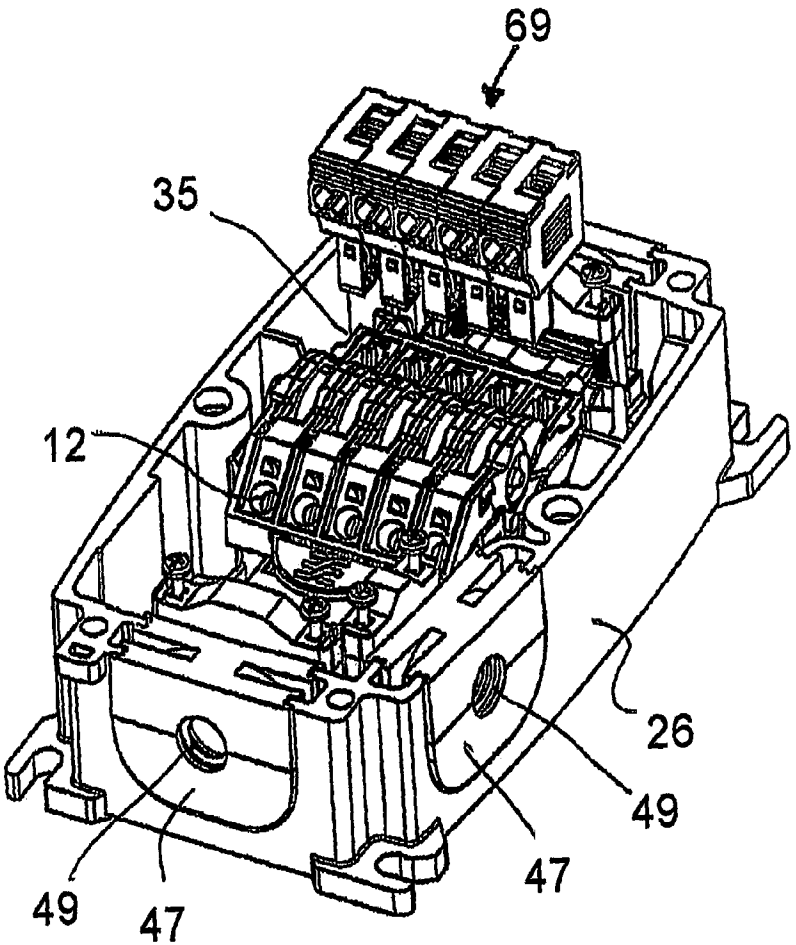
FIGS. 28*a* and 28*b* are perspective view illustrating the manner in which an assembly of output plugs may be connected and disconnected from a connector system according to the present invention.
Figure 28A:
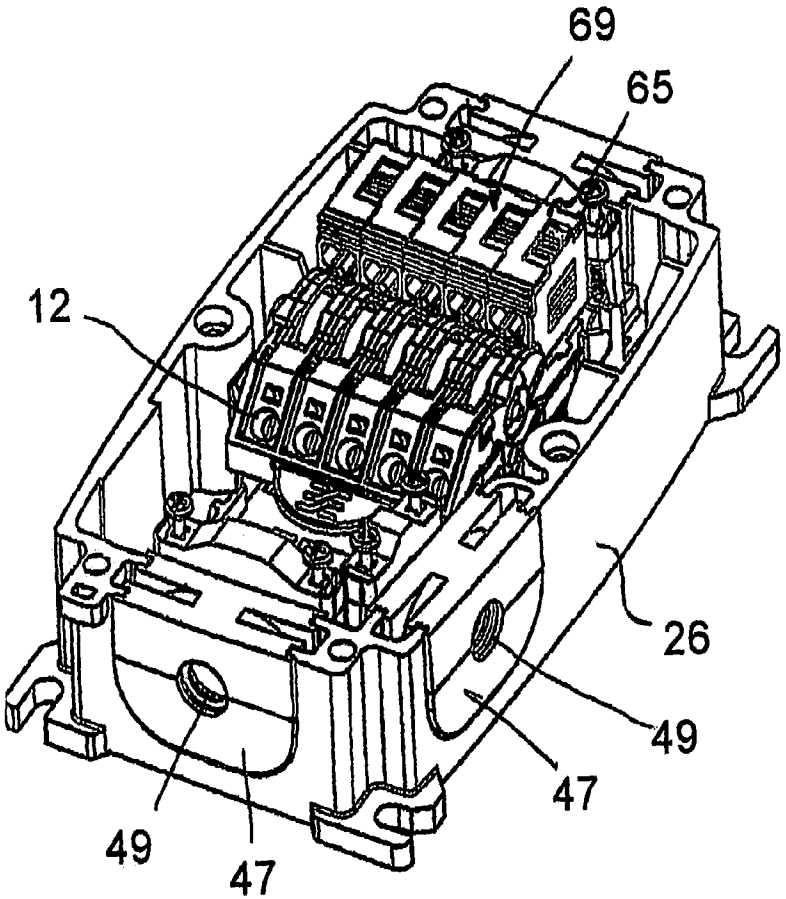
Figure 29B:
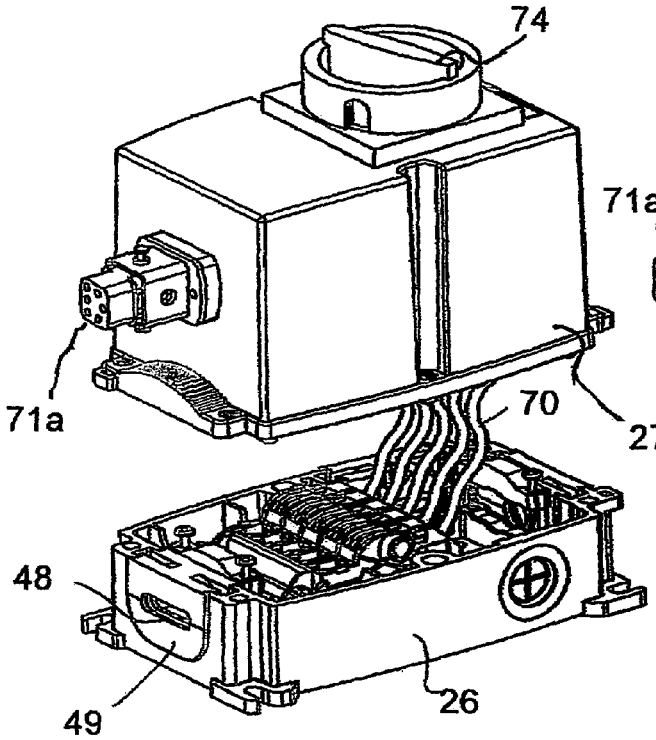
FIGS. 29*a* and 29*b* are perspective views illustrating the manner in which an output plug assembly associated with the outer cover member is connected with the connector assembly, and FIGS. 29*c* and 29*d* a bottom perspective and bottom plan vies of the assembled outer cover member.
Figure 29A:
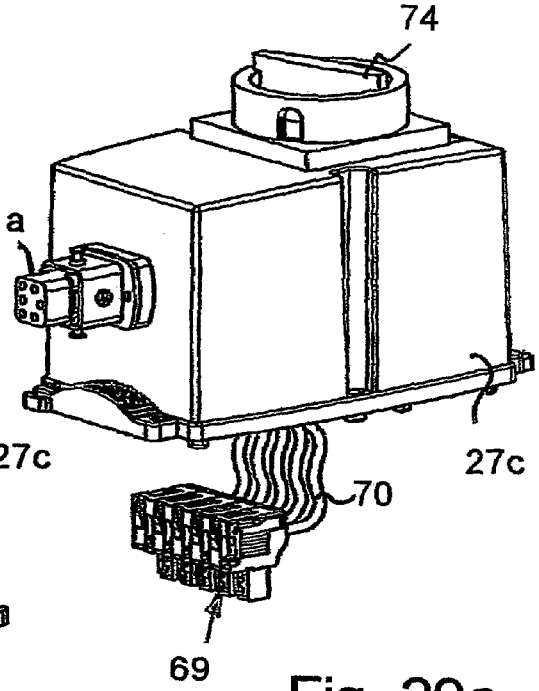
Figure 29C:
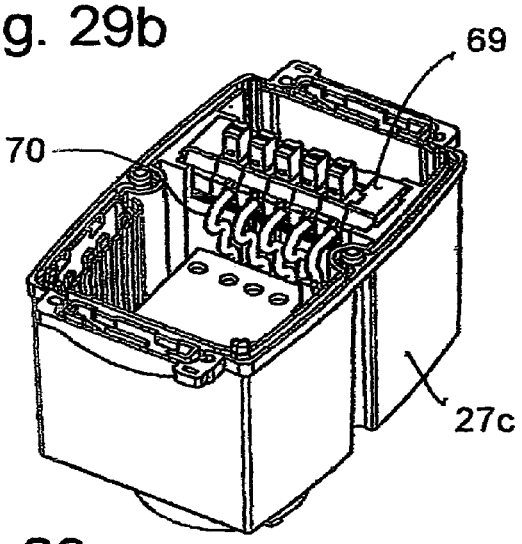
Figure 29D:
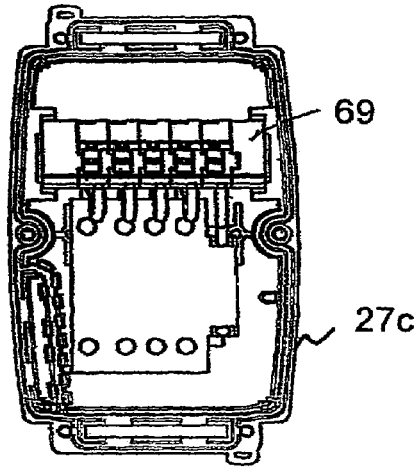
Figure 30:
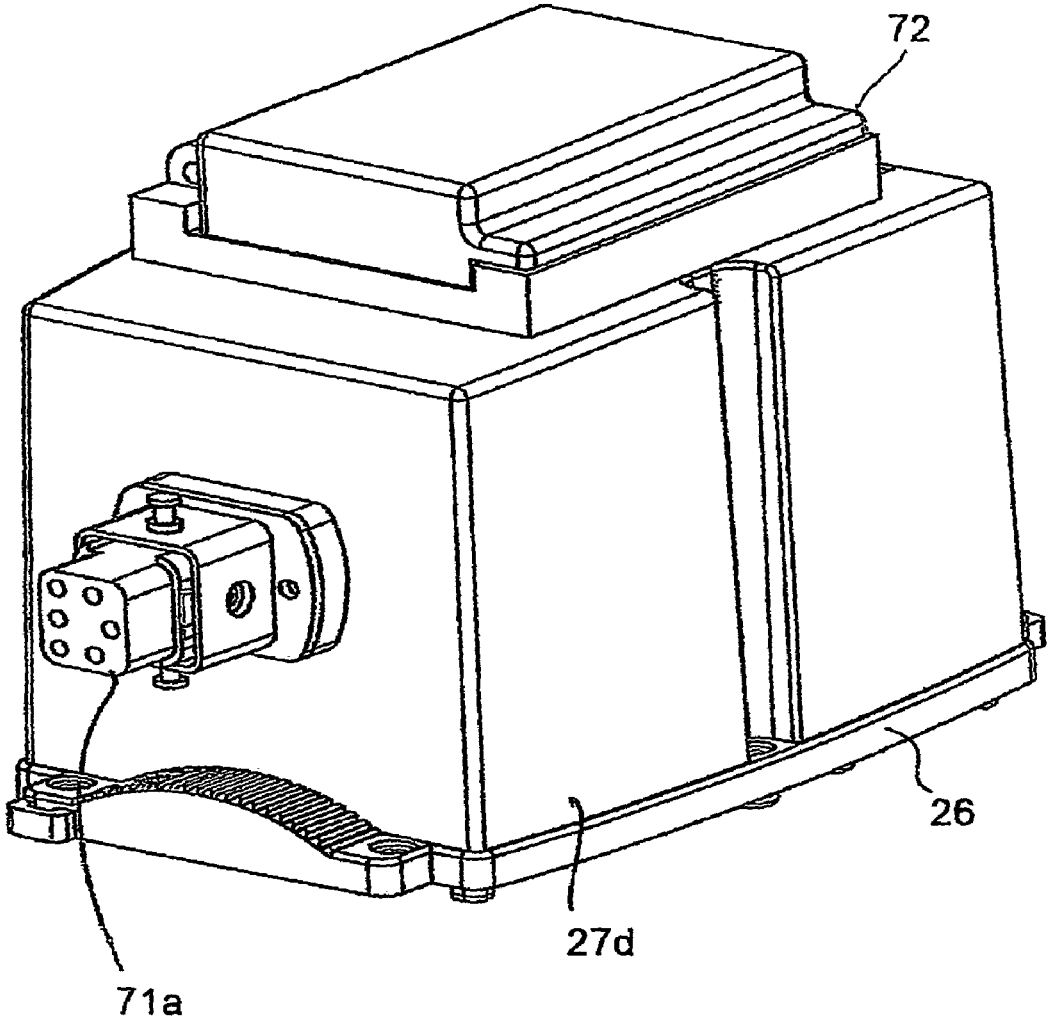
FIG. 30 is a perspective view of the connector arrangement wherein the housing cover member includes an inspection lid.
Figures 31, 32, 33, 34:
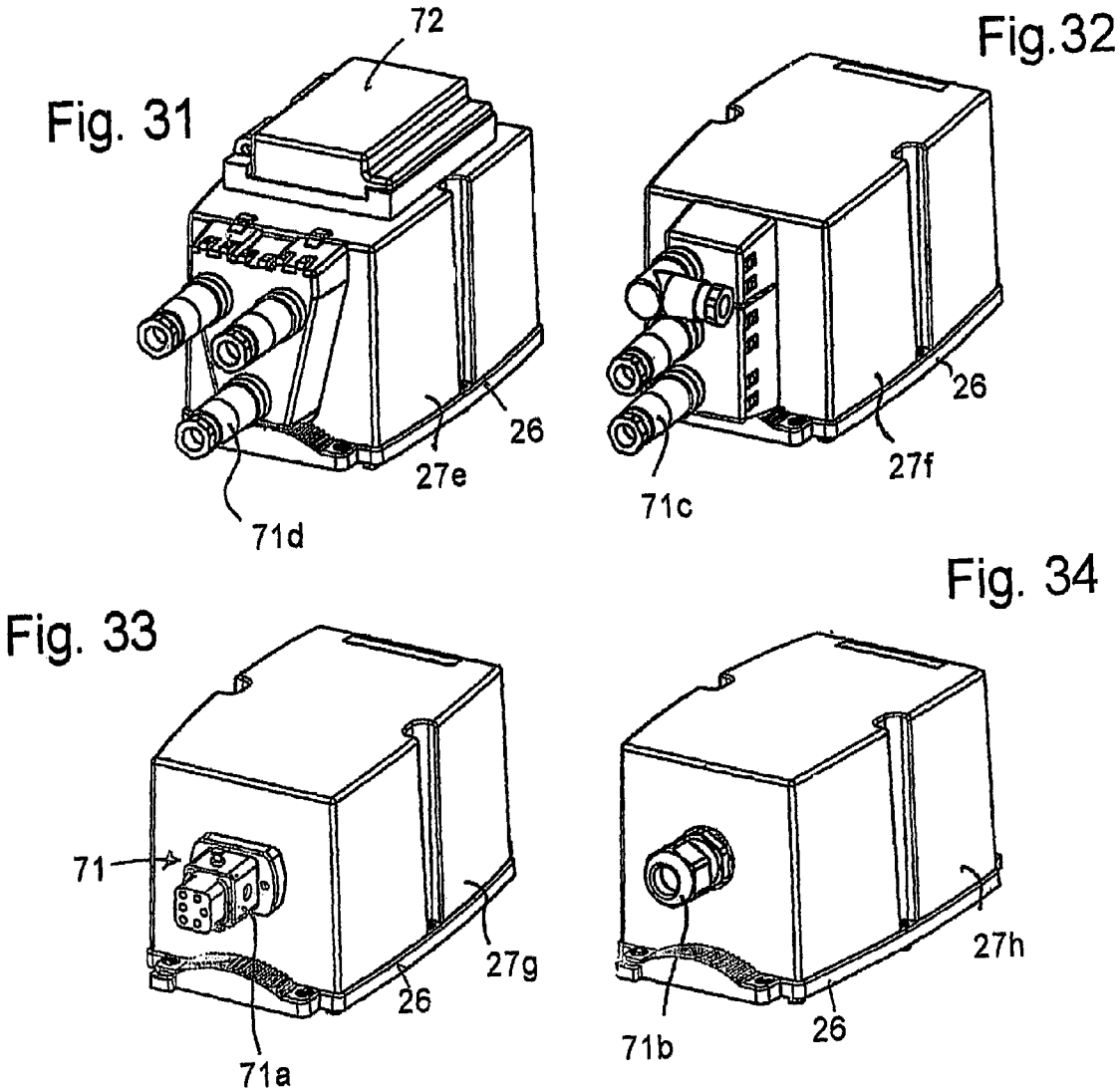
FIGS. 31-37 illustrate various housing cover embodiments.
Figure 36:
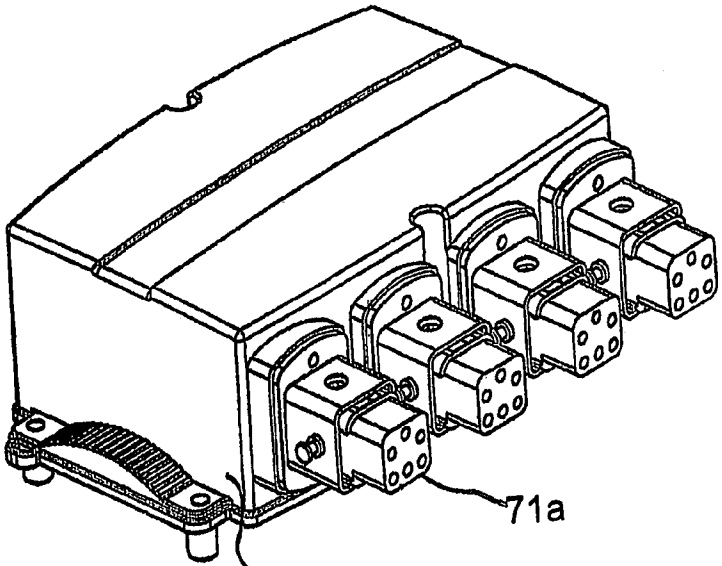
Figure 37:
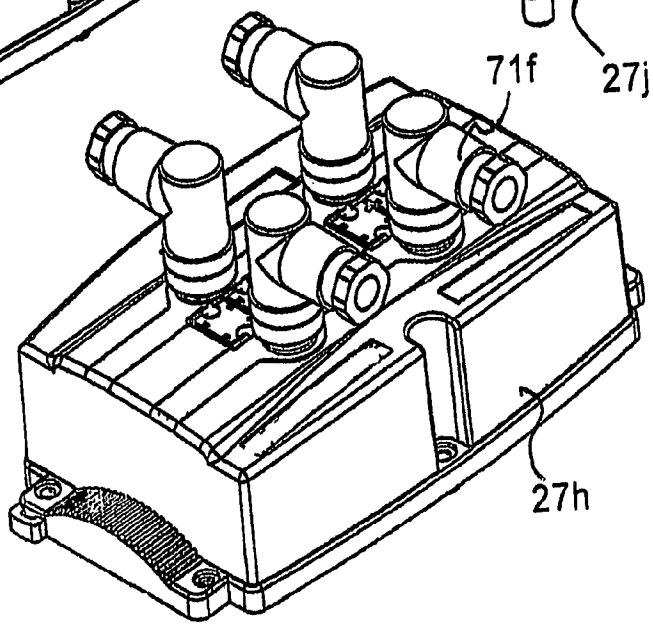
Figure 35:
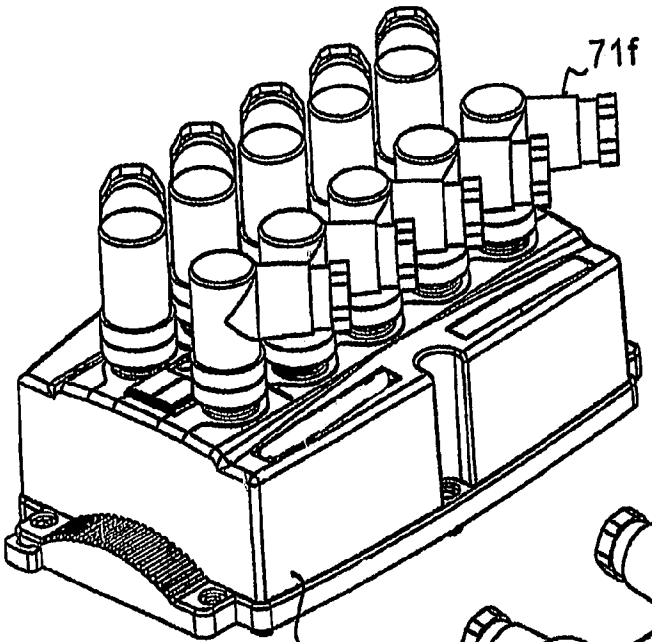
Figure 38A:
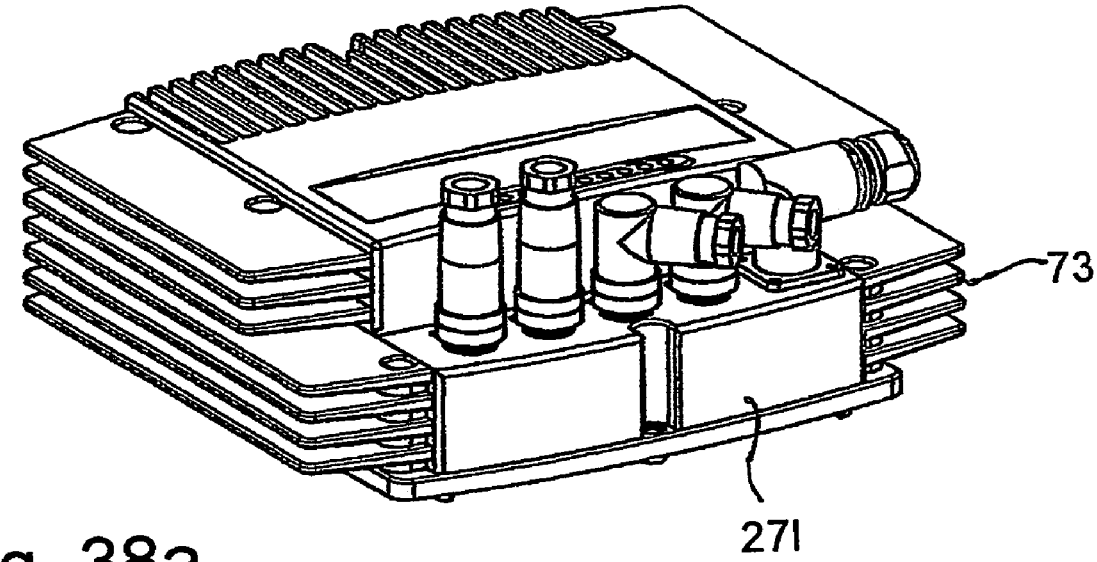
FIGS. 38*a* and 38*b* are front and rear views, respectively, of a connector assembly having an outer housing provided with cooling fins.
Figure 38B:
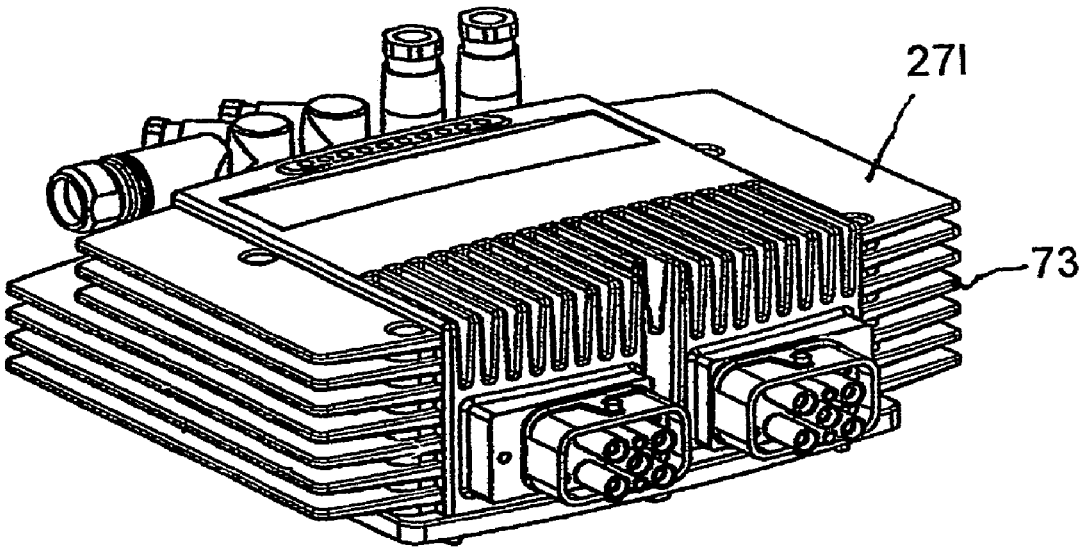

Referring now to FIGS. 28*a*-38*b*, in accordance with a characterizing feature of the present invention, lids or cover members 27 are provided for closing the open-topped support housing and for supporting electrical components that are connected with the piercing unit assembly mounted within the support housing. FIG. 28 shows how, upon plug contacts 13, several composite, especially locked together plug connectors 65 can be connected together as a unitary plug strip 69 which again according to FIG. 29 is connected via additional conductors 70 with contacts of connection plug 71*a* mounted upon lid 27*c*.

The combination especially of FIGS. 24 and 25 clearly shows that—building on extensively identical structural elements—one can create connection devices for flat and round cables. By the selection of various lids 27*a*, 27*b*, 27*c*, etc., one can now—building on the support housing 26—by merely exchanging the lid connection devices, perform the most varied functions that then, together, constitute a connector system. For instance, lid 27*a* (FIGS. 24, and 25) can serve merely as a cover. According to the improvement of the present invention, lid 27*c* can be provided with one or several of the additional connection plugs (or connection sockets) 71*a*, 71*b*, etc., in any desired number, arrangement, and design, for example, as sensor/actuator, M8, M12, RJ45 with an operating selector switch 74 (FIG. 29). On lid 27*d* (FIG. 30) one can again make a slidably displaceable inspection member 72 in order to provide simple access to the electronic components. Moreover, the most varied electrical/electronic structural elements or entire electronic circuits can be integrated into the lid 27. Lids 27 look particularly practical here and they can receive the structural elements of an output switch in any kind, a protective motor switch (see FIG. 38), or the like.

The structural elements of a safety cut-out or power pack can also be integrated into lid 27, as can the electronic units that are required for connection and communication with field equipment such as sensors or actors (for instance, for connection to a bus system, such as AS-i, preferably comprising an energy and a data bus). In this way, using the connection device, one can also make distributors for the connection of the field equipment units or, for instance, for making a star-shaped bus distribution circuit. The lids 271 (FIGS. 38*a* and 38*b*) can, according to a particular variant, also be provided with cooling ribs 73 for the purpose of heat radiation into the environment. Complete metal or partial metal lids as well as synthetic plastic lids can also be made.

Building on standard cover housings, one can thus integrate the most varied functions into the connection devices of the connection system merely by simply exchanging the lids. Manually operating functional elements, such as switches 74 and/or optical displays, such as LED's, can furthermore be provided on the lid. In a supplementary fashion, lids 27 can be provided with markings and the like (not recognizable here).

While in accordance with the provisions of the Patent Statutes the preferred forms and embodiments of the invention have been illustrated and described, it will be apparent to those skilled in the art that changes may be made without deviating from the invention described above.

What is claimed is:

1. A connector system for making selective branch connections to the exposed insulated conductors of a multi-conductor cable having a stripped section from which the outer cable sheath has been removed, comprising;

(a) a base plate supporting the individual insulated conductors of the cable section in parallel spaced relation in a given horizontal plane;

(b) a plurality of generally rectangular conductor piercing units, each of said piercing units including:

(1) a hollow body formed of synthetic plastic insulting material and including a pair of spaced vertical body side walls;

(2) an insulation-piercing contact extending downwardly from said hollow body;

(3) said body having a top surface containing longitudinally spaced first and second recesses;

(4) a pair of output electrical contacts arranged within said body beneath said first and second recesses, respectively; and (5) bus bar means arranged in said body and operable to electrically connect said insulation-piercing contact with said output contacts;

(c) a rectangular hollow frame including a pair of parallel spaced vertical frame side walls, said piercing units being arranged in spaced side-by-side relation between and parallel with said frame side walls, thereby to define a frame and piercing unit assembly;

(d) frame mounting means mounting said frame and piercing unit assembly on said base plate with said piercing units being arranged with their insulation piercing contacts directly above the insulated conductors, respectively, each of said piercing units being vertically displaceable relative to said frame between an upper disconnected position in which said insulation-piercing contact is spaced from the associated insulated conductor, and a lower connected position in which said insulation-piercing piercing contact pierces the insulation layer of, and is in electrical engagement with, the associated conductor;

(e) displacing means for selectively displacing said piercing units between said upper and lower positions, whereby when a given piercing unit is in said lower connected position, the associated conductor is adapted for connection with a pair of output branch lines via the associated piercing contact, bus bar, and pair of output terminals, respectively;

(f) an open-topped rectangular support housing having a horizontal bottom wall, and pairs of opposed vertical side and end walls, said base plate and said frame being arranged in said housing with the cable extending through opposed cable openings contained in said housing end walls, and seal means sealing said cable openings;

(g) a generally-rectangular cover member having a horizontal top wall, and opposed pairs of downwardly extending vertical side and end walls; and (h) at least one electrical component carried by said cover member, said electrical component being electrically connected with said piercing unit assembly.

2. A connector system as defined in claim 1, wherein said cover member includes a plurality of outwardly extending cooling fins.

3. A connector system as defined in claim 1, wherein said electrical component comprises at least one output plug connected with one of said piercing unit output contacts, and an output socket connector mounted in an opening contained in one vertical wall of said cover member.

4. A connector system as defined in claim 3, wherein said electrical component includes a switch mounted in an opening contained in said cover member horizontal top wall.

5. A connector system as defined in claim 1, wherein said cover member horizontal top wall contains an access opening, and further including an access member movably connected with said top wall for closing said access opening.

6. A connector system as defined in claim 5, wherein each of said conductor piercing units contains its top surface a third recess having a bottom wall; and further wherein said displacing means comprises:

(1) a plurality of parallel spaced operating disks arranged in said third recesses for rotation about their central axes, respectively, each of said operating disks containing an eccentrically-arranged longitudinally-extending mounting opening;

(2) a horizontal mounting shaft extending through said mounting openings and supporting said operating disks for rotation in said third recesses, respectively; the ends of said mounting shaft being supported in opposed openings contained in said frame side walls, said shaft also extending through aligned vertical slots contained in said piercing unit body side walls; and (3) means for rotating each of said operating disks about its central axis, whereby upon rotation of said disk about the shaft axis, the associated piercing unit is vertically displaced correspondingly between said connected and disconnected positions.

7. A connector system as defined in claim 6, and further wherein each of said piercing units includes means connecting said operating disk for rotation about its central axis within said third recess, comprising an axial guide pin that extends within corresponding opposed horizontal guide slots contained in said piercing unit body side walls.

8. Apparatus as defined in claim 7, wherein said means for rotating said operating disks includes a recess contained in the outer circumferential surface of each disk, said recess being adapted for engagement by a manually-operated tool.

* * * * *